US008869918B2

(12) United States Patent
Drenth

(10) Patent No.: US 8,869,918 B2
(45) Date of Patent: Oct. 28, 2014

(54) CORE DRILLING TOOLS WITH EXTERNAL FLUID PATHWAYS

(75) Inventor: Christopher L. Drenth, Draper, UT (US)

(73) Assignee: Longyear TM, Inc., South Jordan, UT (US)

( * ) Notice: Subject to any disclaimer, the term of this patent is extended or adjusted under 35 U.S.C. 154(b) by 829 days.

(21) Appl. No.: 12/968,994

(22) Filed: Dec. 15, 2010

(65) Prior Publication Data

US 2011/0083901 A1 Apr. 14, 2011

Related U.S. Application Data

(63) Continuation-in-part of application No. 12/968,127, filed on Dec. 14, 2010, now Pat. No. 8,485,280, and a continuation-in-part of application No. 12/898,878, filed on Oct. 6, 2010.

(60) Provisional application No. 61/287,106, filed on Dec. 16, 2009, provisional application No. 61/249,544, filed on Oct. 7, 2009.

(51) Int. Cl.
*E21B 25/02* (2006.01)

(52) U.S. Cl.
CPC ..... *E21B 25/02* (2013.01)
USPC ..... 175/271; 175/263; 175/290; 175/403

(58) Field of Classification Search
CPC ..... E21B 10/02; E21B 10/47; E21B 10/605; E21B 25/00
USPC ..... 175/271, 272, 263, 284, 290, 403
See application file for complete search history.

(56) References Cited

U.S. PATENT DOCUMENTS

| | | | |
|---|---|---|---|
| 2,510,865 | A | 6/1950 | Cooper |
| 2,829,868 | A | 4/1958 | Pickard |
| 3,092,191 | A | 6/1963 | Mori et al. |
| 3,103,981 | A | 9/1963 | Harper |

(Continued)

FOREIGN PATENT DOCUMENTS

| | | |
|---|---|---|
| EP | 1757770 A1 | 2/2007 |
| GB | 992246 | 5/1965 |

(Continued)

OTHER PUBLICATIONS

International Search Report and Written Opinion dated Oct. 28, 2009 as issued in International Application No. PCT/US2009/041435 filed Apr. 22, 2009.
Office Action dated Jan. 6, 2011 from U.S. Appl. No. 12/427,586, filed Apr. 21, 2009 (17 Pages).
Notice of Allowance dated Feb. 25, 2011 from U.S. Appl. No. 12/427,586, filed Apr. 21, 2009 (6 Pages).

(Continued)

*Primary Examiner* — Kenneth L Thompson
*Assistant Examiner* — Elizabeth Gitlin
(74) *Attorney, Agent, or Firm* — Ballard Spahr LLP

(57) ABSTRACT

Implementations of the present invention include a core barrel assembly including external fluid pathways extending generally axially long the outer surface of the core barrel assembly. The one or more external fluid pathways can allow for increased fluid flow around a latch mechanism. The increased fluid flow around the latch mechanism can allow the core barrel assembly to travel faster within the drill string, can allow drilling fluid to pass by the latch mechanism when engaged. Implementations of the present invention also include drilling systems including external fluid pathways, and methods of retrieving a core sample using such drilling systems.

26 Claims, 15 Drawing Sheets

(56) References Cited

U.S. PATENT DOCUMENTS

| | | | | |
|---|---|---|---|---|
| 3,115,188 | A | 12/1963 | Cochran et al. | |
| 3,126,064 | A | 3/1964 | Miller | |
| 3,225,845 | A | 12/1965 | Koontz et al. | |
| 3,333,647 | A | 8/1967 | Karich | |
| 3,346,059 | A | 10/1967 | Svendsen | |
| 3,363,705 | A | 1/1968 | Jensen | |
| 3,461,981 | A | 8/1969 | Casper et al. | |
| 3,494,418 | A | 2/1970 | Young | |
| 3,543,870 | A | 12/1970 | Martinsen | |
| 3,667,558 | A | 6/1972 | Lambot | |
| 3,977,482 | A | 8/1976 | Reed et al. | |
| 4,418,770 | A | 12/1983 | Lambot | |
| 4,466,497 | A * | 8/1984 | Soinski et al. | 175/246 |
| 4,664,204 | A | 5/1987 | Nenkov et al. | |
| D293,789 | S | 1/1988 | Tiffin | |
| 4,800,969 | A | 1/1989 | Thompson | |
| D300,223 | S | 3/1989 | Livingstone | |
| 4,823,872 | A | 4/1989 | Hopmann | |
| 4,832,138 | A | 5/1989 | Hallez | |
| 4,834,198 | A | 5/1989 | Thompson | |
| 4,930,587 | A | 6/1990 | Young et al. | |
| 5,020,612 | A | 6/1991 | Williams | |
| D330,900 | S | 11/1992 | Wakegijig | |
| 5,253,720 | A | 10/1993 | Radford et al. | |
| 5,267,620 | A | 12/1993 | Lee | |
| 5,311,950 | A | 5/1994 | Spektor | |
| 5,325,930 | A | 7/1994 | Harrison | |
| 5,662,182 | A | 9/1997 | McLeod et al. | |
| 5,785,134 | A * | 7/1998 | McLeod et al. | 175/258 |
| 5,799,742 | A | 9/1998 | Soinski | |
| 5,934,393 | A | 8/1999 | Marshall | |
| 5,992,543 | A | 11/1999 | Soinski et al. | |
| D420,013 | S | 2/2000 | Warren et al. | |
| 6,019,181 | A * | 2/2000 | Soinski et al. | 175/58 |
| 6,029,758 | A | 2/2000 | Novacovicci et al. | |
| 6,039,129 | A | 3/2000 | McLeod | |
| 6,059,053 | A | 5/2000 | McLeod | |
| 6,089,335 | A | 7/2000 | Able | |
| 6,371,205 | B1 | 4/2002 | Langan et al. | |
| 6,425,449 | B1 | 7/2002 | Marshall | |
| 6,564,885 | B2 | 5/2003 | Attwater | |
| 6,708,784 | B1 | 3/2004 | Borg | |
| 7,296,638 | B2 | 11/2007 | Beach | |
| 7,314,101 | B2 | 1/2008 | Beach | |
| 7,730,965 | B2 | 6/2010 | Jordan et al. | |
| D622,293 | S | 8/2010 | Drenth et al. | |
| D622,294 | S | 8/2010 | Drenth et al. | |
| D622,741 | S | 8/2010 | Drenth et al. | |
| D624,564 | S | 9/2010 | Drenth et al. | |
| 7,841,400 | B2 | 11/2010 | Wells et al. | |
| D632,309 | S | 2/2011 | Coyle, Jr. | |
| 7,900,716 | B2 | 3/2011 | Ibrahim et al. | |
| 7,967,085 | B2 | 6/2011 | Drenth | |
| D643,443 | S | 8/2011 | Drenth | |
| D643,859 | S | 8/2011 | Drenth | |
| D644,668 | S | 9/2011 | Drenth | |
| D644,688 | S | 9/2011 | Ritter et al. | |
| D647,540 | S | 10/2011 | Drenth | |
| D664,566 | S | 7/2012 | Drenth | |
| D664,567 | S | 7/2012 | Drenth | |
| 2004/0216927 | A1 | 11/2004 | Beach | |
| 2005/0034894 | A1 | 2/2005 | Beach et al. | |
| 2005/0241825 | A1 | 11/2005 | Burris et al. | |
| 2009/0032256 | A1 | 2/2009 | Sun et al. | |
| 2009/0173542 | A1 | 7/2009 | Ibrahim et al. | |
| 2009/0260882 | A1 | 10/2009 | Drenth | |
| 2009/0283328 | A1 | 11/2009 | Drivdahl et al. | |
| 2011/0079435 | A1 | 4/2011 | Drenth et al. | |
| 2011/0079436 | A1 | 4/2011 | Drenth et al. | |
| 2011/0083901 | A1 | 4/2011 | Drenth | |
| 2013/0105227 | A1 | 5/2013 | Drenth | |

FOREIGN PATENT DOCUMENTS

| | | | |
|---|---|---|---|
| WO | 9503475 | | 2/1995 |
| WO | 03038232 | A1 | 5/2003 |
| WO | 2009108113 | A1 | 9/2009 |
| WO | 2010096860 | A1 | 9/2010 |

OTHER PUBLICATIONS

Notice of Allowance dated Apr. 6, 2011 from U.S. Appl. No. 29/383,340, filed Jan. 14, 2011 (10 pages).
Notice of Allowance dated Apr. 6, 2011 from U.S. Appl. No. 29/383,561, filed Jan. 19, 2011 (10 pages).
Notice of Allowance dated Apr. 8, 2011 from U.S. Appl. No. 29/383,572, filed Jan. 19, 2011 (10 pages).
Notice of Allowance dated May 26, 2011 from U.S. Appl. No. 29/383,623, filed Jan. 20, 2011 (10 pages).
Issue Notification dated Jun. 8, 2011 from U.S. Appl. No. 12/427,586, filed Apr. 21, 2009 (1 page).
Notice of Allowance dated Aug. 1, 2011 from U.S. Appl. No. 29/383,554, filed Jan. 19, 2011 (10 pages).
Supplemental Notice of Allowance dated Jul. 11, 2011 from U.S. Appl. No. 29/383,340, filed Jan. 14, 2011 (6 pages).
Supplemental Notice of Allowance dated Jul. 11, 2011 from U.S. Appl. No. 29/383,561, filed Jan. 19, 2011 (6 pages).
Issue Notification dated Aug. 3, 2011 from U.S. Appl. No. 29/383,561, filed Jan. 19, 2011 (1 page).
Issue Notification dated Jul. 27, 2011 from U.S. Appl. No. 29/383,572, filed Jan. 19, 2011 (1 page).
Office Action dated Aug. 1, 2011 from U.S. Appl. No. 12/528,949, filed Aug. 27, 2009 (8 pages).
Notice of Allowance dated Aug. 4, 2011 from U.S. Appl. No. 29/383,623, filed Jan. 20, 2011 (10 pages).
First Action Interview Pilot Program Pre-Interview Communication dated Jul. 8, 2011 from U.S. Appl. No. 13/094,581, filed Apr. 26, 2011 (4 pages).
First Action Interview Pilot Program Pre-Interview Communication dated Jul. 1, 2011 from U.S. Appl. No. 13/094,674, filed Apr. 26, 2011 (4 pages).
Notice of Allowance dated Aug. 25, 2011 from U.S. Appl. No. 13/094,581, filed Apr. 26, 2011 (9 pages).
Issue Notification dated Oct. 19, 2011 from U.S. Appl. No. 13/094,581, filed Apr. 26, 2011 (1 page).
Notice of Allowance dated Aug. 19, 2011 from U.S. Appl. No. 13/094,674, filed Apr. 26, 2011 (11 pages).
Issue Notification dated Oct. 19, 2011 from U.S. Appl. No. 13/094,674, filed Apr. 26, 2011 (1 page).
Notice of Allowance dated Sep. 20, 2011 from U.S. Appl. No. 29/383,554, filed Jan. 19, 2011 (10 pages).
Issue Notification dated Aug. 17, 2011 from U.S. Appl. No. 29/383,340, filed Jan. 14, 2011 (1 page).
International Search Report and Written Opinion dated Jul. 27, 2011 from International Patent Application No. PCT/US2010/060744 filed Dec. 16, 2010 (6 pages).
International Search Report and Written Opinion dated Jul. 27, 2011 from International Patent Application No. PCT/US2010/060742 filed Dec. 16, 2010 (6 pages).
Issue Notification dated Oct. 5, 2011 from U.S. Appl. No. 29/383,623, filed Jan. 20, 2011 (1 page).
Issue Notification dated Nov. 2, 2011 from U.S. Appl. No. 29/383,554, filed Jan. 19, 2011 (1 page).
Notice of Non-Compliant Amendment issued Oct. 31, 2011 for U.S. Appl. No. 12/528,949, filed Aug. 27, 2009 (Inventor—Drenth; Applicant—Boart Longyear) (pp. 1-16).
Applicant-Initiated Interview Summary issued Nov. 1, 2011 for U.S. Appl. No. 12/528,949, filed Aug. 27, 2009 (Inventor—Drenth; Applicant—Boart Longyear) (pp. 1-7).
Final Office Action issued Apr. 5, 2012 for U.S. Appl. No. 12/528,949, filed Aug. 27, 2009 (Inventor—Drenth; Applicant—Boart Longyear) (pp. 1-10).

* cited by examiner

CORE DRILLING TOOLS WITH EXTERNAL FLUID PATHWAYS

CROSS-REFERENCE TO RELATED APPLICATIONS

This application is a continuation-in-part application of U.S. patent application Ser. No. 12/968,127, filed on Dec. 14, 2010, and entitled "Core Drilling Tools with Retractably Lockable Driven Latch Mechanisms" which claims priority to and the benefit of U.S. Provisional Application No. 61/287,106, filed Dec. 16, 2009, entitled "Driven Latch Mechanism for High Productivity Core Drilling." This application is also a continuation-in-part application of U.S. patent application Ser. No. 12/898,878, filed on Oct. 6, 2010, and entitled "Driven Latch Mechanism," which claims priority to and the benefit of U.S. Provisional Application No. 61/249,544, filed Oct. 7, 2009, entitled "Driven Latch Mechanism" and U.S. Provisional Application No. 61/287,106, filed Dec. 16, 2009, entitled "Driven Latch Mechanism for High Productivity Core Drilling." The contents of the above-referenced patent applications are hereby incorporated by reference in their entirety.

BACKGROUND OF THE INVENTION

1. The Field of the Invention

Implementations of the present invention relate generally to drilling devices and methods that may be used to drill geological and/or manmade formations. In particular, implementations of the present invention relate to core barrel assemblies.

2. The Relevant Technology

Core drilling (or core sampling) includes obtaining core samples of subterranean formations at various depths for various reasons. For example, a retrieved core sample can indicate what materials, such as petroleum, precious metals, and other desirable materials, are present or are likely to be present in a particular formation, and at what depths. In some cases, core sampling can be used to give a geological timeline of materials and events. As such, core sampling may be used to determine the desirability of further exploration in a particular area.

Wireline drilling systems are one common type of drilling system for retrieving a core sample. In a wireline drilling process, a core drill bit is attached to the leading edge of an outer tube or drill rod. A drill string is then formed by attaching a series of drill rods that are assembled together section by section as the outer tube is lowered deeper into the desired formation. A core barrel assembly is then lowered or pumped into the drill string. The core drill bit is rotated, pushed, and/or vibrated into the formation, thereby causing a sample of the desired material to enter into the core barrel assembly. Once the core sample is obtained, the core barrel assembly is retrieved from the drill string using a wireline. The core sample can then be removed from the core barrel assembly.

Core barrel assemblies commonly include a core barrel for receiving the core, and a head assembly for attaching the core barrel assembly to the wireline. Typically, the core barrel assembly is lowered into the drill string until the core barrel reaches a landing seat on an outer tube or distal most drill rod. At this point a latch on the head assembly is deployed to restrict the movement of the core barrel assembly with respect to the drill rod. Once latched, the core barrel assembly is then advanced into the formation along with the drill rod, causing material to fill the core barrel.

Often it may be desirable to obtain core samples at various depths in a formation. Furthermore, in some cases, it may be desirable to retrieve core samples at depths of thousands of feet below ground-level, or otherwise along a drilling path. In such cases, retrieving a core sample may require the time consuming and costly process of removing the entire drill string (or tripping the drill string out) from the borehole. In other cases, a wireline drilling system may be used to avoid the hassle and time associated with tripping the entire drill string. Even when using a wireline drilling system, tripping the core barrel assembly in and out of the drill string is nonetheless time-consuming.

Accordingly, there are a number of disadvantages in conventional wireline systems that can be addressed.

BRIEF SUMMARY OF THE INVENTION

One or more implementations of the present invention overcome one or more problems in the art with drilling tools, systems, and methods for effectively and efficiently tripping a core barrel assembly in and out of a drill string. For example, one or more implementations of the present invention include a core barrel assembly having one or more external fluid pathways. In particular, one or more components of the core barrel assembly can include axial fluid grooves that allow for increased fluid flow between the core barrel assembly and an inner surface of a drill string. Accordingly, one or more implementations of the present invention can increase productivity and efficiency in core drilling operations by reducing the time required to a core barrel assembly to travel through a drill string.

For example, one implementation of latch body of a core barrel assembly includes a tubular body including an outer surface and an inner surface. The tubular body can be adapted to house a latch mechanism for securing the tubular body to a drill string. Additionally, the latch body can include at least two latch openings extending through the tubular body. Furthermore, the latch body can include at least one groove extending into the outer surface of the tubular body. The at least one groove can extend axially along the outer surface of the tubular body.

Additionally, another implementation of latch body of a core barrel assembly can include a tubular body including an outer surface and an inner surface. The tubular body can be adapted to house a latch mechanism for securing the tubular body to a drill string. Further, the latch body can include at least one fluid port extending through the tubular body. The at least one fluid port can allow fluid to flow between the inner surface and the outer surface of the tubular body. The latch body can also include at least one groove extending into the outer surface of the tubular body. The at least one groove can extend axially along the outer surface of the tubular body and can intersect the at least one fluid port.

Still further, an implementation of a core barrel head assembly can include a latch body including an inner surface and an outer surface. In addition, the latch body can include a plurality of latch openings extending through the latch body. The latch body can also include a latch mechanism secured within the latch body. The latch mechanism can include a plurality of latch members configured to move radially in and out of the plurality of latch openings. Additionally, the latch body can include at least one groove extending into the outer surface. The at least one groove can extend axially along the outer surface of the tubular body.

Furthermore, an implementation of a drilling system for retrieving a core sample can include a drill string comprising a plurality of drill rods. Also, the drilling system can include a core barrel assembly adapted to be inserted within the drill string. The core barrel assembly can include a latch body and a latch mechanism positioned within the latch body. The latch mechanism can lock the core barrel assembly relative to the drill string. Additionally, the core barrel assembly can include a fluid port extending through the latch body. Still further, the latch body can include at least one groove extending into an outer surface of the latch body. The at least one groove can extend axially along the outer surface of the tubular body and can intersect the fluid port.

In addition to the foregoing, a method of drilling can involve inserting a core barrel assembly within a drill string. The core barrel assembly can include at least one groove extending into an outer surface of the core barrel assembly. The at least one groove can extend axially along the outer surface of the core barrel assembly. The method can also involve sending the core barrel assembly along the drill string to a drilling position. As the core barrel assembly travels within the drill string, fluid can flow in the at least one groove from a first end of a latch body to a second end of said latch body. Additionally, the method can involve rotating the drill string thereby causing the plurality of latch members to extend radially from the core barrel assembly into an annular groove of the drill string; thereby locking the core barrel assembly relative to the drill string.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. It should be noted that the figures are not drawn to scale, and that elements of similar structure or function are generally represented by like reference numerals for illustrative purposes throughout the figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention are directed toward drilling tools, systems, and methods for effectively and efficiently tripping a core barrel assembly in and out of a drill string. For example, one or more implementations of the present invention include a core barrel assembly having one or more external fluid pathways. In particular, one or more components of the core barrel assembly can include axial fluid grooves that allow for increased fluid flow between the core barrel assembly and an inner surface of a drill string. Accordingly, one or more implementations of the present invention can increase productivity and efficiency in core drilling operations by reducing the time required to a core barrel assembly to travel through a drill string.

As explained in greater detail below, the external fluid pathways can allow for increased fluid flow around the core barrel assembly. The increased fluid flow can provide increased cooling of the drill bit. Additionally, the increased fluid flow can provide for increased flushing of cuttings to the surface. Thus, the external fluid pathways can improve drilling performance. Furthermore, the external fluid pathways of one or more implementations can increase the space between the outer surfaces of the core barrel assembly and the drill string; thereby allowing for easier passage of drilling fluid or ground water that may be present during tripping of the core barrel assembly. Accordingly, one or more implementations of the present invention can increase productivity and efficiency in core drilling operations by reducing the time required to trip the core barrel assembly in or out of the drill string.

Furthermore, the external fluid pathways can allow for the components of the core barrel assembly to have increased size without reducing or restricting the cross-sectional area for fluid flow. Thus, in one or more implementations the external fluid pathways can help ensure that the core barrel head assembly has sufficient material cross-section to provide an adequate strength to withstand the forces created during drilling and retrieval of the core barrel assembly. For instance, the core barrel components can have increased thickness to provide increased strength.

Additionally, or alternatively, the external fluid pathways can allow the core barrel assembly to have an outer diameter with only a slight clearance relative to the inner diameter of the drill string with reducing fluid flow. Thus, the external fluid pathways can allow for internal core barrel head components with increased size or number. For instance, the external fluid pathways can allow for an increased number of latch elements, latch mechanism design, and valve control design. For example, in one or more implementations the external fluid pathways can allow the core barrel head assembly to include a driven latch mechanism with four or more wedge members, and still allow for sufficient fluid flow about the core barrel head assembly.

Figure 1:
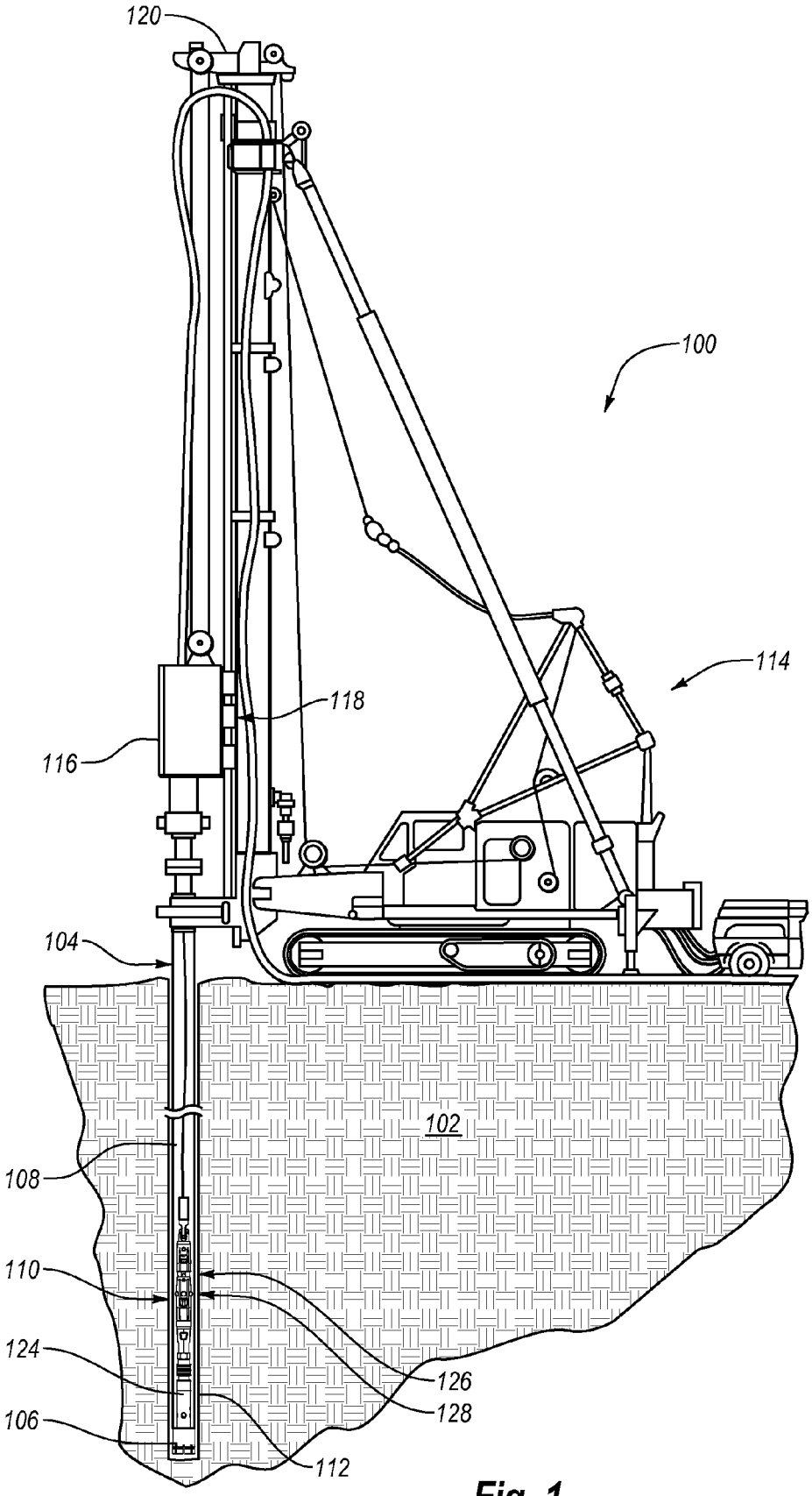
FIG. 1 illustrates a schematic view a drilling system including a core barrel assembly having external fluid pathways in accordance with an implementation of the present invention.

As shown in FIG. 1, a drilling system 100 may be used to retrieve a core sample from a formation 102. The drilling system 100 may include a drill string 104 that may include a drill bit 106 (for example, an open-faced drill bit or other type of drill bit) and/or one or more drill rods 108. The drilling system 100 may also include an in-hole assembly, such as a core barrel assembly 110. The core barrel assembly 110 can include a latch mechanism 128 configured to lock the core barrel assembly at least partially within a distal drill rod or outer tube 112, as explained in greater detail below. As used herein the terms "down" and "distal end" refer to the end of the drill string 104 including the drill bit 106. While the terms "up" or "proximal" refer to the end of the drill string 104 opposite the drill bit 106. Additionally, the terms "axial" or "axially" refer to the direction along the length of the drill string 104.

The drilling system 100 may include a drill rig 114 that may rotate and/or push the drill bit 106, the core barrel assembly 110, the drill rods 108 and/or other portions of the drill string 104 into the formation 102. The drill rig 114 may include, for example, a rotary drill head 116, a sled assembly 118, and a mast 120. The drill head 116 may be coupled to the drill string 104, and can allow the rotary drill head 116 to rotate the drill bit 106, the core barrel assembly 110, the drill rods 108 and/or other portions of the drill string 104. If desired, the rotary drill head 116 may be configured to vary the speed and/or direction that it rotates these components. The sled assembly 118 can move relative to the mast 120. As the sled assembly 118 moves relative to the mast 120, the sled assembly 118 may provide a force against the rotary drill head 116, which may push the drill bit 106, the core barrel assembly 110, the drill rods 108 and/or other portions of the drill string 104 further into the formation 102, for example, while they are being rotated.

It will be appreciated, however, that the drill rig 114 does not require a rotary drill head, a sled assembly, a slide frame or a drive assembly and that the drill rig 114 may include other suitable components. It will also be appreciated that the drilling system 100 does not require a drill rig and that the drilling system 100 may include other suitable components that may rotate and/or push the drill bit 106, the core barrel assembly 110, the drill rods 108 and/or other portions of the drill string 104 into the formation 102. For example, sonic, percussive, or down hole motors may be used.

The core barrel assembly 110 may include an inner tube or core barrel 124, and a head assembly 126. The head assembly 126 can include a latch mechanism 128. As explained in greater detail below, the driven latch mechanism 128 can lock the core barrel 124 within the drill string 104, and particularly to the outer tube 112. Furthermore, in one or more implementations, the latch mechanism 128 can rotationally lock the core barrel assembly 110 to the drill string 104 thereby preventing wear due to rotation or sliding between the mating components of the latch mechanism 128 and the drill string 104.

Once the core barrel 124 is locked to the outer tube 112 via the latch mechanism 128, the drill bit 106, the core barrel assembly 110, the drill rods 108 and/or other portions of the drill string 104 may be rotated and/or pushed into the formation 102 to allow a core sample to be collected within the core barrel 124. After the core sample is collected, the core barrel assembly 110 may be unlocked from the outer tube 112 and drill string 104. The core barrel assembly 110 may then be retrieved, for instance using a wireline retrieval system, while the drill bit 106, the outer tube 112, one or more of the drill rods 108 and/or other portions of the drill string 104 remain within the borehole.

The core sample may be removed from core barrel 124 of the retrieved core barrel assembly 110. After the core sample is removed, the core barrel assembly 110 may be sent back and locked to the outer tube 112. With the core barrel assembly 110 once again locked to the outer tube 112, the drill bit 106, the core barrel assembly 110, the drill rods 108 and/or other portions of the drill string 104 may be rotated and/or pushed further into the formation 102 to allow another core sample to be collected within the core barrel 124. The core barrel assembly 110 may be repeatedly retrieved and sent back in this manner to obtain several core samples, while the drill bit 106, the outer tube 112, one or more of the drill rods 108 and/or other portions of the drill string 104 remain within the borehole. This may advantageously reduce the time necessary to obtain core samples because the drill string 104 need not be tripped out of the borehole for each core sample.

Figure 2:
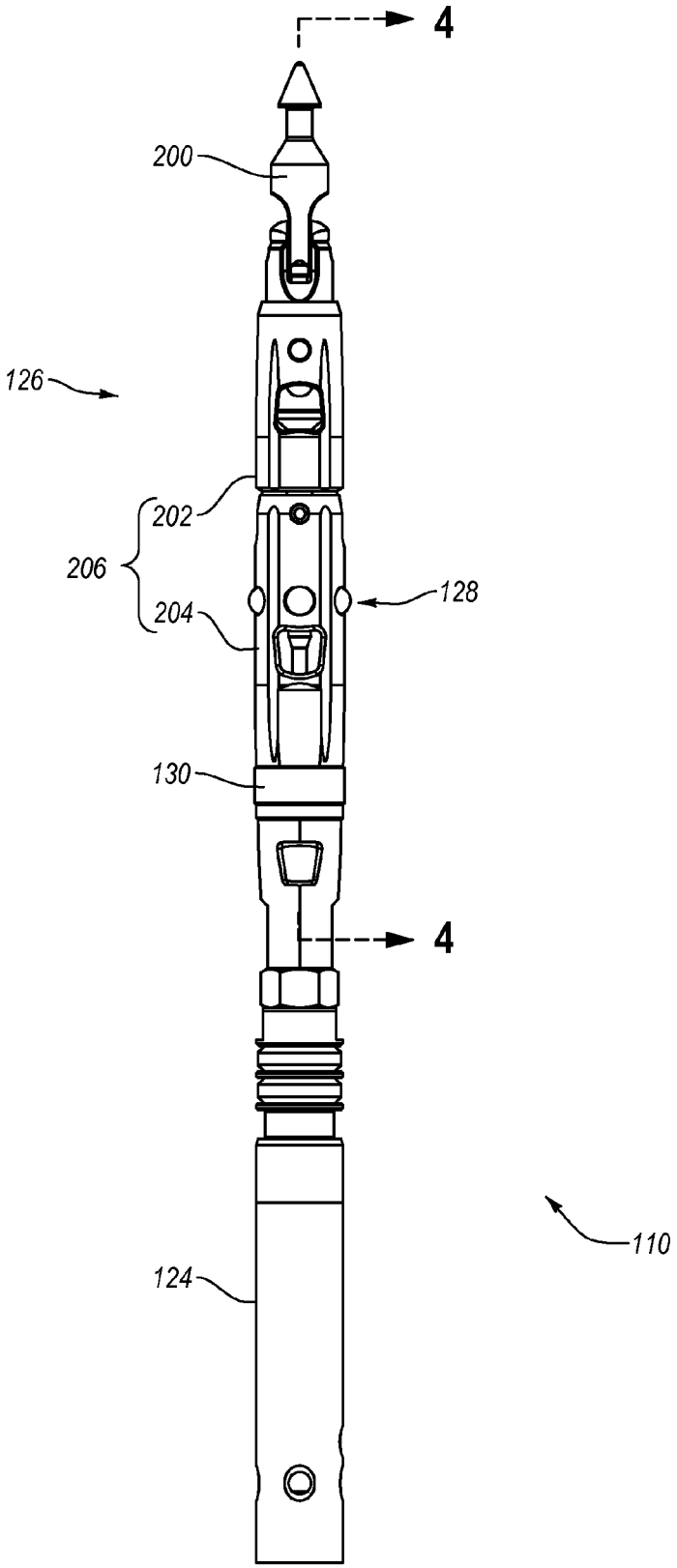
FIG. 2 illustrates an enlarged view of the core barrel assembly of FIG. 1, further illustrating a external fluid pathways on a head assembly.

FIG. 2 illustrates the core barrel assembly 110 in greater detail. As previously mentioned, the core barrel assembly 110 can include a head assembly 126 and a core barrel 124. The head assembly 126 can include a spear head assembly 200 adapted to couple with an overshot, which in turn can be attached to a wireline. Furthermore, the head assembly 126 can include a latch body 206. As shown by FIG. 2, the latch body 206 can comprise a first member 202 and a sleeve 204. The latch body 206 can comprise a tubular body configured to house the latch mechanism 128, which can lock the core barrel assembly 110 within the drill string 104. Additionally, as explained in greater detail below, the latch body can include one or more external fluid pathways.

One will appreciate in light of the disclosure herein, that the external fluid pathways of one or more implementations of the present invention can be incorporated in any type of latch body. For instance, the latch body 206 shown and described in relation to FIGS. 2-6D includes two components (i.e., first member 202 and sleeve 204) moveably coupled to each other. In alternative implementations, the latch body can comprise a single unitary piece, such as latch body 906 described in relation to FIG. 9 below. Along similar lines, the latch bodies of one or more implementations can be configured to house any type of latch mechanism. For example, the latch mechanism may comprise any number of latch arms, latch rollers, latch balls, multi-component linkages, or any mechanism configured to move the latching mechanism into the engaged position with a drill string.

In one or more implementations, the latch mechanism can comprise a driven latch mechanism, such as those described U.S. patent application Ser. No. 12/968,127, filed on Dec. 14, 2010, and U.S. patent application Ser. No. 12/898,878, filed on Oct. 6, 2010, the disclose of each of which is incorporated by reference herein. Indeed, the external fluid pathways of the present invention may be particularly suited for use with a driven latch mechanism as they allow for an increased number of latch or wedge members and internal components with greater size. For the most part herein below, the external fluid pathways are described as being on a latch body configured to house a driven latch mechanism for ease in description. The present invention is not so limited; however, and can be incorporated with any type or core barrel assembly and latch mechanism.

In other words, the following description supplies specific details in order to provide a thorough understanding of the invention. Nevertheless, the skilled artisan would understand that the apparatus and associated methods of using the apparatus can be implemented and used without employing these specific details. Indeed, the apparatus and associated methods can be placed into practice by modifying the illustrated apparatus and associated methods and can be used in conjunction with any other apparatus and techniques. For example, while the description below focuses on core sampling operations, the apparatus and associated methods could be equally applied in other drilling processes, such as in conventional borehole drilling, and may be used with any number or varieties of drilling systems, such as rotary drill systems, percussive drill systems, etc.

Figure 3:
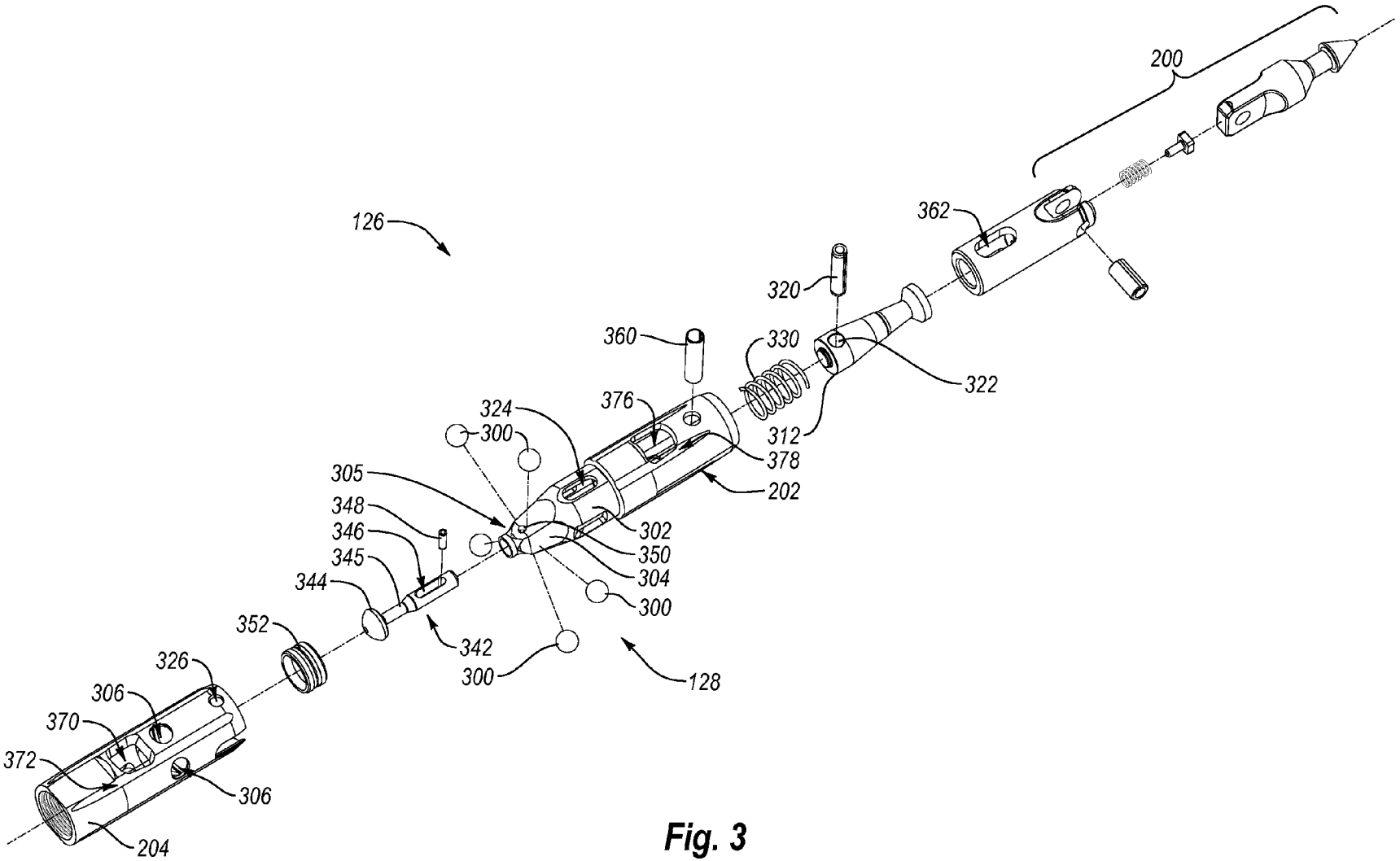
FIG. 3 illustrates an exploded view of the head assembly of FIG. 2.
Figure 4:
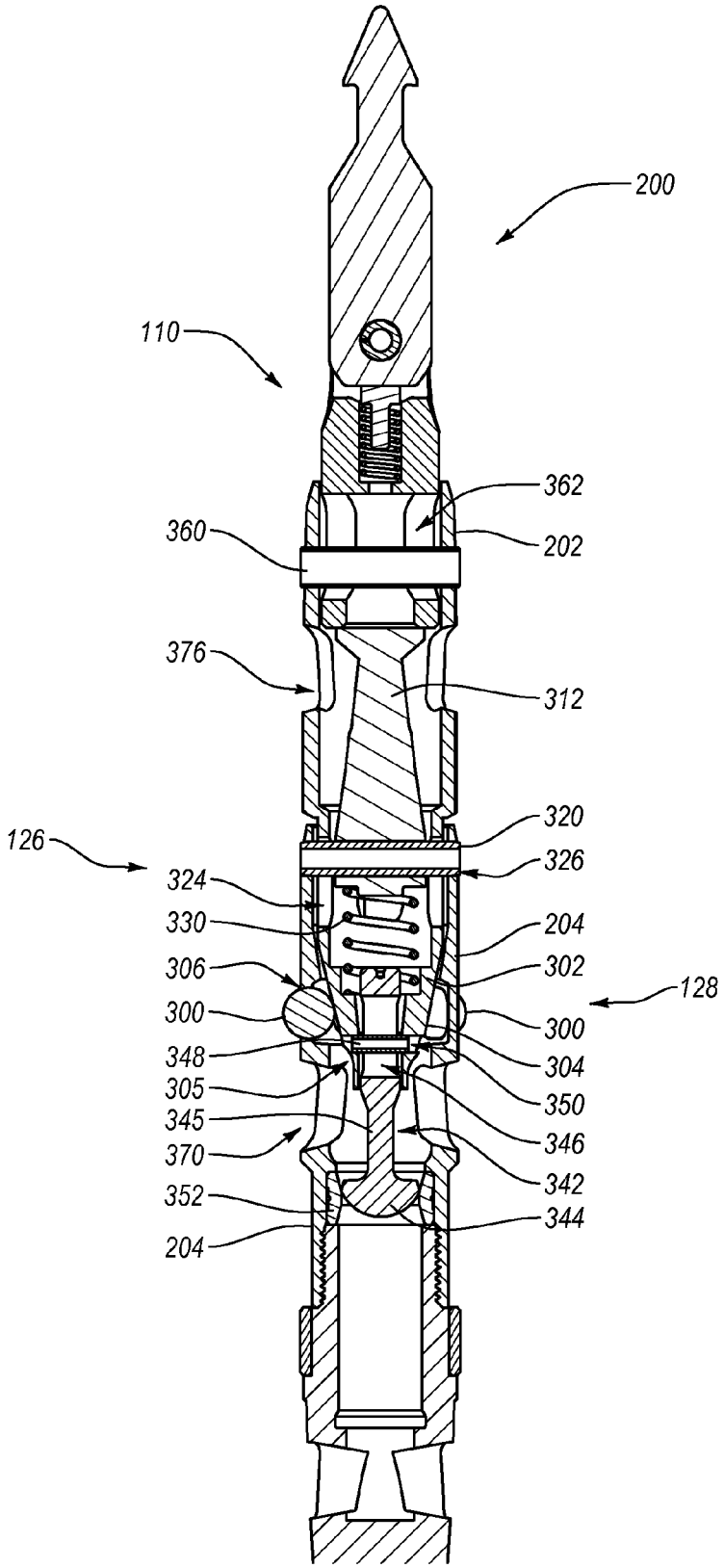
FIG. 4 illustrates a cross-sectional view of the core barrel assembly of FIG. 2 taken along the line 4-4 of FIG. 2.

FIGS. 3 and 4 and the corresponding text, illustrate or describe a number of components, details, and features of the core barrel assembly 110 shown in FIGS. 1 and 2. In particular, FIG. 3 illustrates an exploded view of the head assembly 126. While FIG. 4 illustrates a side, cross-sectional view of the core barrel assembly 110 taken along the line 4-4 of FIG. 2. FIG. 4 illustrates the driven latch mechanism 128 in a fully deployed state. As shown by FIGS. 3 and 4, the driven latch mechanism 128 can include a plurality of wedge members 300. In one or more implementations, the wedge members 300 can comprise a spherical shape or be roller balls, as shown in FIGS. 3 and 4. The wedge members 300 may be made of steel, or other iron alloys, titanium and titanium alloys, compounds using aramid fibers, lubrication impregnated nylons or plastics, combinations thereof, or other suitable materials.

The wedge members 300 can be positioned on or against a driving member 302. More particularly, the wedge members 300 can be positioned on generally planar or flat driving surfaces 304. As explained in greater detail below, the generally planar configuration of the driving surfaces 304 can allow the wedge members 300 to be wedged between the driving member 302 and the inner diameter of a drill string to rotationally lock the core barrel assembly 110 to the drill string.

Figure 11:
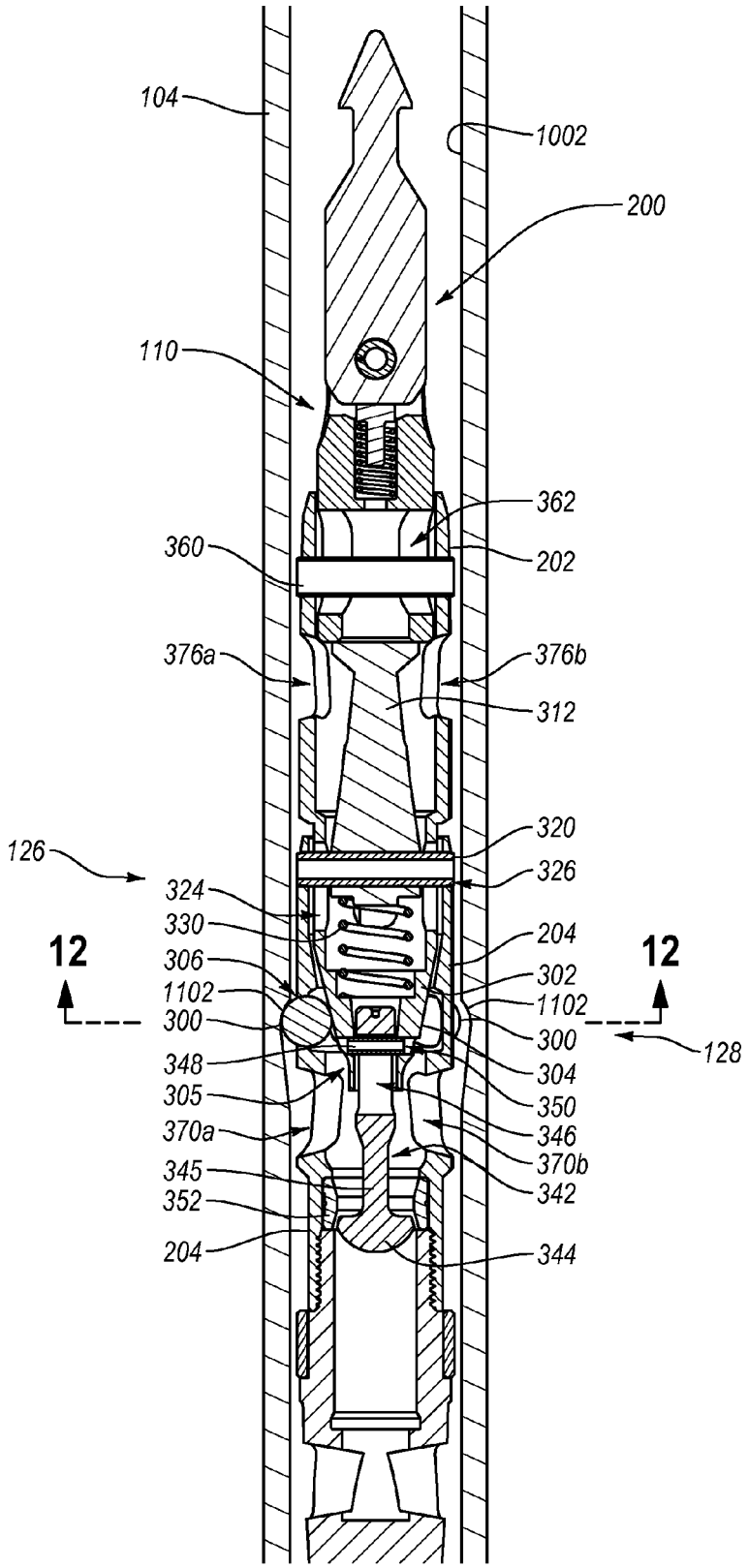
FIG. 11 illustrates a cross-sectional view of the core barrel assembly similar to FIG. 4, albeit with the driven latch mechanism latched to the drill string.
Figure 12:
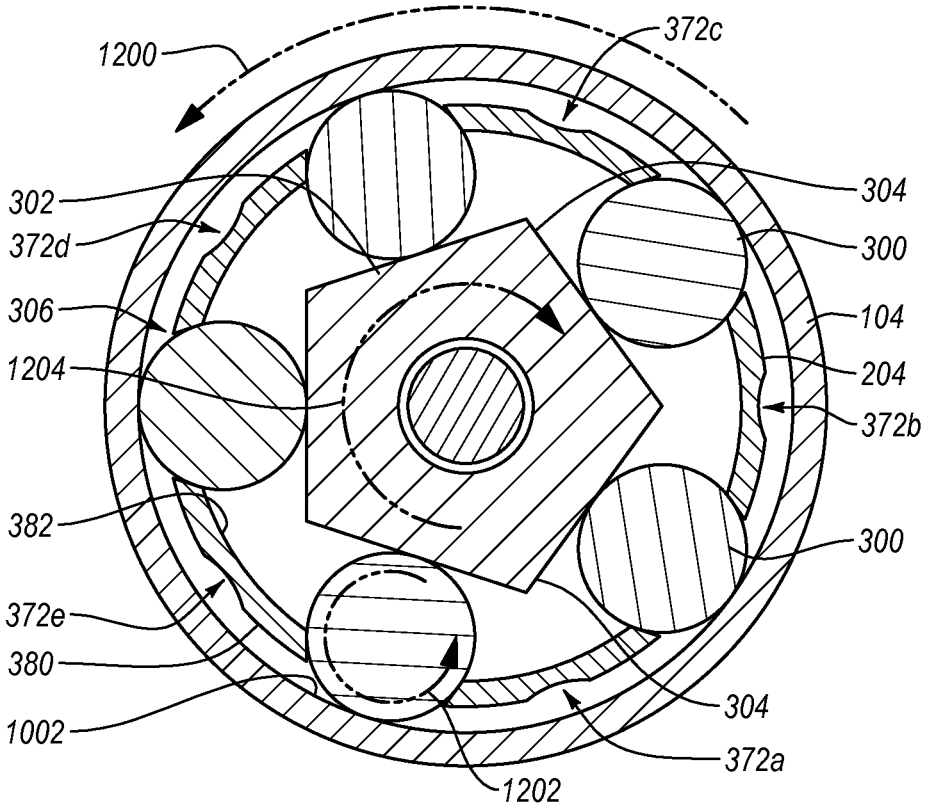
FIG. 12 illustrates a cross-sectional view of the core barrel assembly of FIG. 11 taken along the line 12-12 of FIG. 11.

FIGS. 3 and 4 further illustrate that the wedge members 300 can extend through latch openings 306 extending through the generally hollow sleeve 204. The latch openings 306 can help hold or maintain the wedge members 300 in contact with the driving surfaces 304, which in turn can ensure that axial movement of the driving member 302 relative to the sleeve 204 results in radial displacement of the wedge members 300. As explained in greater detail below, as the driving member 302 moves axially toward or farther into the sleeve 204, the driving surfaces 304 can force the wedge members 300 radially outward of the sleeve 204 to a deployed or latched position (FIG. 12). Along similar lines, as the driving member 302 moves axially away from, or out of the sleeve 204, the wedge members 300 can radially retract at least partially into the sleeve 204 into a released position (FIG. 11).

As alluded to earlier, in at least one implementation, the driving member 302 can include one or more grooves for locking the wedge members 300 in position axially along the driving member 302. For example, the driving member 302 can include a retracted groove 305. As explained in greater detail below, the retracted groove 305 can receive and hold the wedge members 300 in a radially retracted position during tripping of the core barrel assembly 110 in or out of a drill string 104.

In one or more implementations, the driving member 302, and more particularly the planar driving surfaces 304 can have a taper, as shown in FIGS. 3 and 4. The taper can allow the driving member 302 to force the wedge balls 300 radially outward as the driving member 302 moves axially closer to, or within, the sleeve 204. Also, the taper of the driving member 302 can allow the wedge members 300 to radially retract at least partially into the sleeve 204 when the driving member 302 moves axially away from the sleeve 204.

In at least one implementation, the refracted groove 305 can be positioned on the smaller end of the taper of the driving member 302. This can ensure that when the wedge members 300 are secured within the retracted groove 305, the wedge members 300 will be at least partially radially refracted within the sleeve 204. In at least one implementation, the wedge members 300 can be fully retracted within the sleeve 204, when received within the refracted groove 305. In any event, the retracted groove 305 can maintain the wedge members 300 sufficiently within the sleeve 204 as to not engage the drill string 104. Maintaining the wedge members 300 thus retracted within the sleeve 204 can reduce contact between the wedge members 300 and the drill string 104, which in turn can reduce friction and thereby allow for rapid tripping of the core barrel assembly 110 in and out of the drill string 104.

FIGS. 3 and 4 further illustrate that in addition to first member 202 can be generally hollow and can house a landing member 312. One will appreciate that the sleeve 204, first member 202, and landing member 312 can all be coupled together. In particular, as shown by FIGS. 3 and 4, in at least one implementation a first pin 320 can extend through a mounting channel 322 in the landing member 312. The first pin 320 can then extend through mounting slots 324 of the first member 202 (and more particularly the driving member 302). From the mounting slots 324, the first pin 320 can extend into mounting holes 326 in the sleeve 204. Thus, the landing member 312 and the sleeve 204 can be axially fixed relative to each other. On the other hand, the mounting slots 324 can allow the landing member 312 and the sleeve 204 to move axially relative to the first member 202 or vice versa. Axial movement between the first member 202 and the sleeve 204 can cause the driving surfaces 304 to move the wedge members 300 radially outward and inward.

In alternative implementations, the sleeve 204 and the first member 202 can comprise a single component (i.e., a latch body). In other words, the sleeve 204 and the first member 202 can be fixed relative to each other. In such implementations, the driving member 302 can be moveably coupled to the latch body (i.e., sleeve 204 and first member 202).

FIGS. 3 and 4 further illustrate that the head assembly 126 can include a biasing member 330. The biasing member 330 can be positioned between the landing member 312 and the driving member 302. Thus, the biasing member 330 can bias the driving member 302 toward or into the sleeve 204. Thus, in one or more implementations, the biasing member 330 can bias the driving member 302 against the wedge members 300, thereby biasing the wedge members 300 radially outward. The biasing member 330 can comprise a mechanical (e.g., spring), magnetic, or other mechanism configured to bias the driving member 302 toward or into the sleeve 204. For example, FIGS. 3 and 4 illustrate that the biasing member 330 can comprise a coil spring.

Still further, FIGS. 3 and 4 illustrate that the head assembly 126 can include a fluid control member 342. The fluid control member 342 can include a piston 344 and a shaft 345. The shaft 345 can include a channel 346 defined therein. A piston pin 348 can extend within the channel 346 and be coupled to pin holes 350 within the first member 202 (and particularly the driving member 302). The channel 346 can thus allow the piston 344 to move axially relative to the driving member 302. In particular, as explained in greater detail below, the piston 344 can move axially relative to the first member 202 in and out of engagement with a seal or bushing 352 forming a valve. The interaction of the fluid control member 342 will be discussed in more detail hereinafter.

In one or more alternative implementations, the fluid control member 342 can be rigidly attached to the driving member 302. In such implementations, the piston pin 348 can extend into a pin hole rather than a channel 346, which prevents the fluid control member 342 from moving axially relative to the driving member 302.

As previously mentioned, the head assembly 126 can include a spearhead assembly 200. The spear head assembly 200 can be coupled to the first member 202 via a spearhead pin 360. The spearhead pin 360 can extend within a mounting channel 362 in the spearhead assembly 200, thereby allowing the spearhead assembly 200 to move axially relative to the first member 202.

As previously mentioned, the latch body 206 can include features to allow fluid to flow through or about the latch body 206. For example, FIG. 3 illustrates that the sleeve 204 can include one or more fluid ports 370 extending through the sleeve 204. Additionally, the sleeve 204 can include one or more fluid grooves 372 extending axially at least partially along the length thereof. Similarly, first member 202 can include one or more fluid ports 376 extending through the first member 202. Furthermore, the first member 202 can include one or more fluid grooves 378 extending axially at least partially along the length thereof.

One will appreciate in light of the disclosure herein that the fluid ports 370, 376 can allow fluid to flow from the outside diameter of the head assembly 126 into the center or bore of the head assembly 126. The fluid grooves 372, 378 on the other hand can allow fluid to flow axially along the head assembly 126 between the outer diameter of the head assembly 126 and the inner diameter of a drill string 104. In addition to the fluid ports and axial fluid grooves, the core barrel assembly 110 can include a central bore that can allow fluid to flow internally through the core barrel assembly 110.

Figure 5:
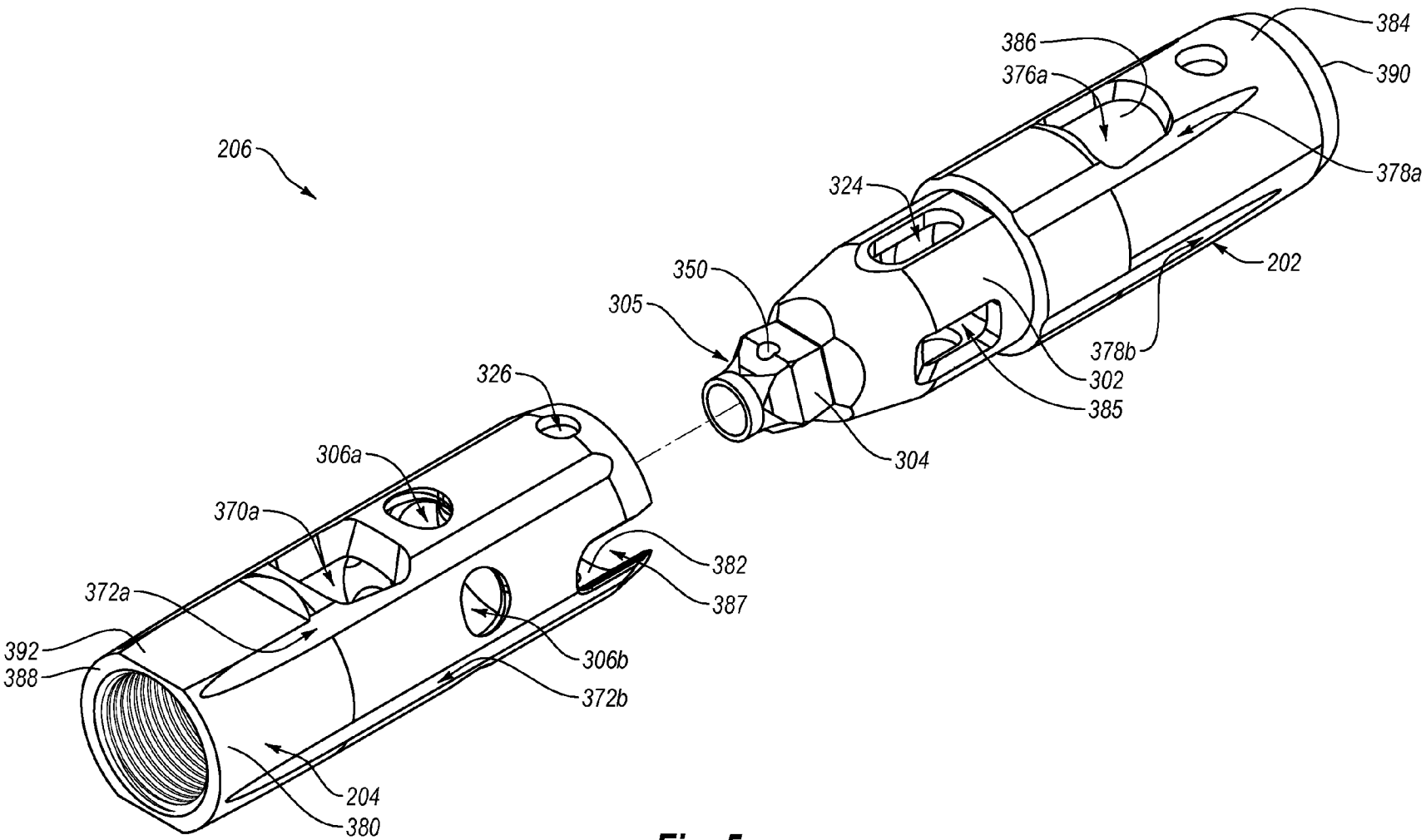
FIG. 5 illustrates an exploded perspective view of the latch body of the core barrel assembly of FIG. 2.
Figure 6D:
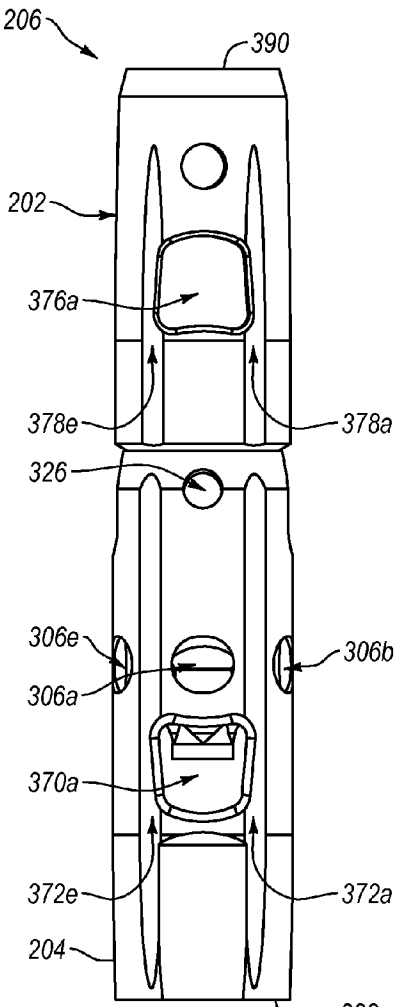
FIG. 6D illustrates a side view of the latch body of FIG. 5, similar to FIG. 6A, albeit rotated by 270 degrees.
Figure 6C:
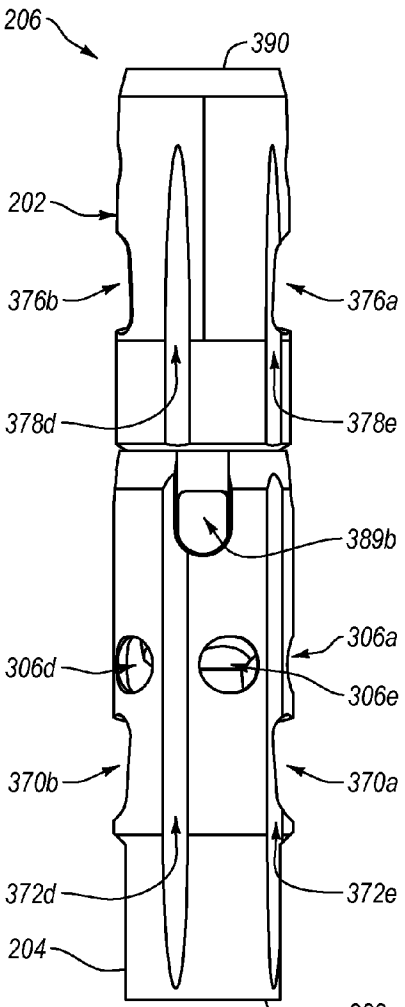
FIG. 6C illustrates a side view of the latch body of FIG. 5, similar to FIG. 6A, albeit rotated by degrees 180 degrees.
Figure 6B:
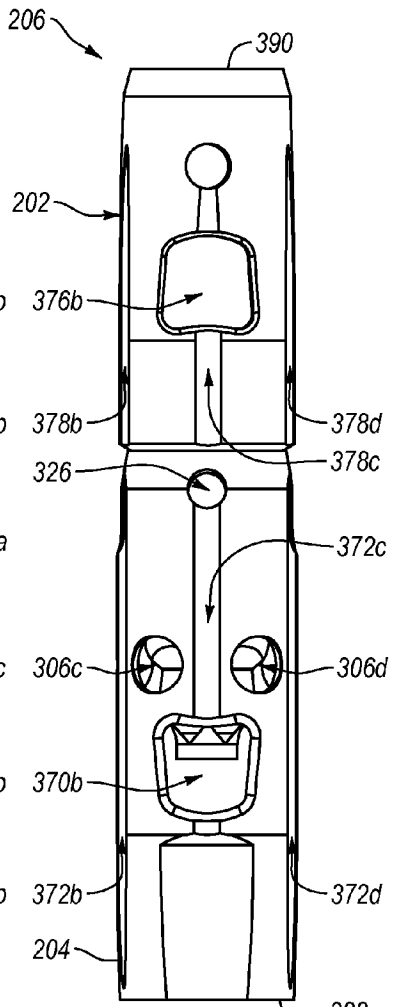
FIG. 6B illustrates a side view of the latch body of FIG. 5, similar to FIG. 6A, albeit rotated by 90 degrees.
Figure 6A:
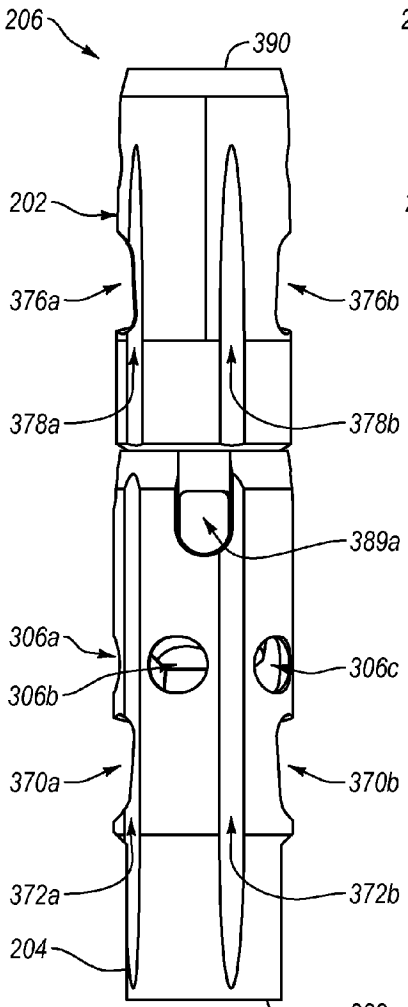
FIG. 6A illustrates a side view of the latch body of FIG. 5.
Figure 6E:
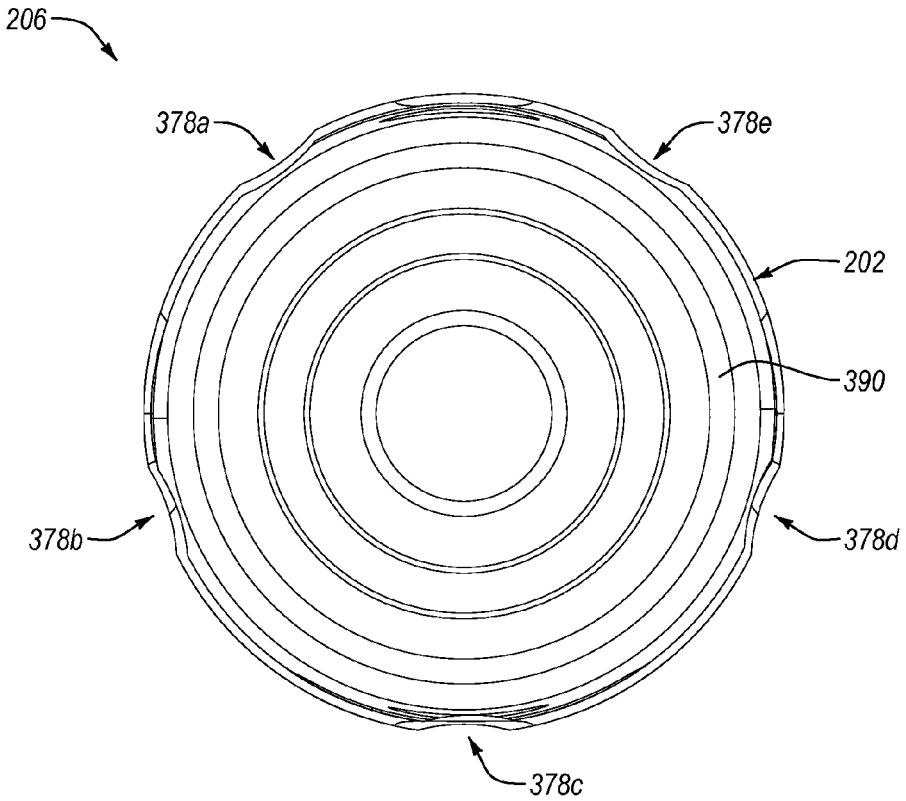
FIG. 6E illustrates a top view of the latch body of FIG. 5.
Figure 6F:
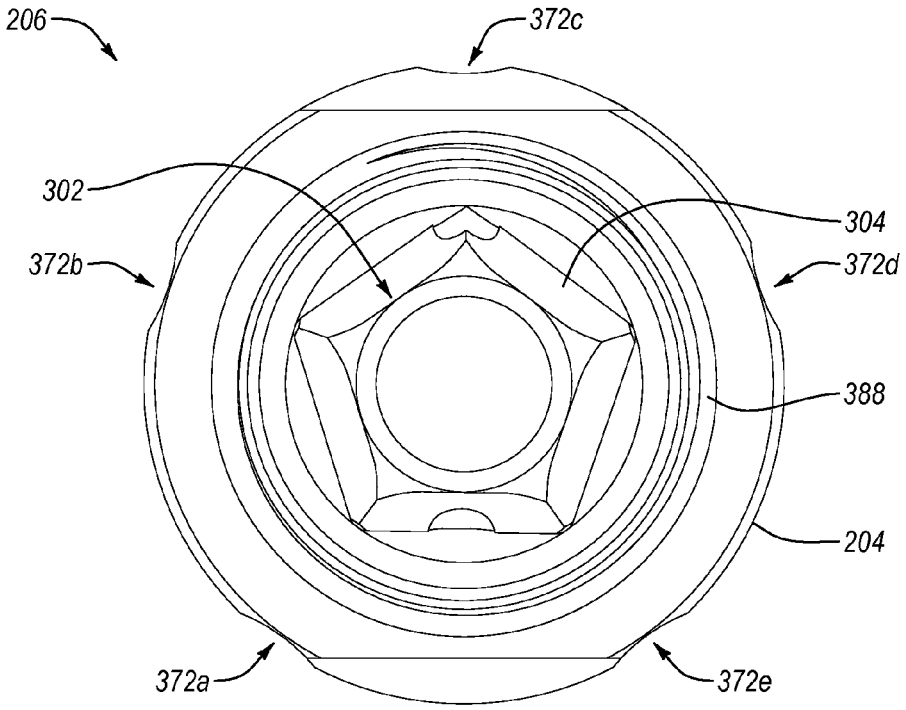
FIG. 6F illustrates a bottom view of the latch body of FIG. 5.

Referring now to FIGS. 5-6F, the fluid ports and external fluid pathways of the latch body 206 will be described in greater detail. As shown in FIGS. 5-6F, the sleeve can include five fluid grooves 372*a*, 372*b*, 372*c*, 372*d*, 372*e* extending into the outer surface 380 of the sleeve 204. Similarly, the first member 202 can include five fluid grooves 378*a*, 378*b*, 378*c*, 378*d*, 378*e* extending into the outer surface 384 of the first member 202. Each of the fluid grooves 372*a-e*, 378*a-e* can extend into the outer surfaces 380, 384 of the latch body 206 toward the inner surfaces 382, 386 of the latch body 206. Alternative implementations can include more or less than five fluid grooves.

The depth of the fluid grooves 372*a-e*, 378*a-e*, or depth the fluid grooves extend into the outer surfaces 380, 384, can be sufficient to allow for adequate fluid to flow along the latch body 206 without weakening the structural integrity of the latch body 206. For example, in one or more implementations the depth of the fluid grooves 372*a-e*, 378*a-e* can be between about five percent and about fifty percent of the gauge (distance between the outer surfaces 380, 384 and inner surfaces 382, 386) of the latch body 206. In further implementations, the depth of the fluid grooves 372*a-e*, 378*a-e* can be between about ten percent and about twenty-five percent of the gauge of the latch body 206. In yet further implementations, the depth of the fluid grooves 372*a-e*, 378*a-e* can be between about ten percent and about twenty percent of the gauge of the latch body 206.

In addition to extending radially into the outer surfaces 380, 384 of the latch body 206, the fluid grooves 372*a-e*, 378*a-e* can extend axially along at least a portion of the length of the latch body 206. In particular, in one or more implementations the fluid grooves 372*a-e*, 378*a-e* can extend linearly along the length of the latch body 206 as shown in FIGS. 6A-6D. In alternative implementations, the fluid grooves 372*a-e*, 378*a-e* can have a spiral or helical configuration. In one or more implementations the fluid grooves 372*a-e* of the sleeve 204 can align with the fluid grooves 378*a-e* of the first member 202 such that the combined or aligned fluid grooves 372*a-e*, 378*a-e* extend substantially the entire length of the latch body 206. In such implementations, the combined fluid grooves 372*a* and 378*a* can be considered a single fluid groove. In alternative implementations, the fluid grooves 372*a-e* of the sleeve 204 can be misaligned with the fluid grooves 378*a-e* of the first member 202. In such implementations, the misaligned fluid grooves can be considered separate fluid grooves that extend along only a portion (i.e., the sleeve 204 or first member 202) of the latch body 206.

The latch body 206 can include any number of fluid grooves 372*a-e*, 378*a-e*. For example, in FIGS. 5-6F, the latch body 206 includes five fluid grooves that extend along the length thereof. In one or more implementations the number of fluid grooves 372*a-e*, 378*a-e* can be based on the number of latch openings 306. For example, FIGS. 6A-6D show that the latch body 206 can include five latch openings 306*a-e* and five fluid grooves 372*a-e*, 378*a-e*. In particular, each of the fluid grooves 372*a-e*, 378*a-e* can be positioned circumferentially between adjacent latch openings 306*a-e*. As explained in greater detail below, this can allow fluid to flow between the outer surfaces 380, 384 of the latch body 206 and the inner surface of the drill string 104 even when the wedge members 300 are engaged with the drill string 104.

In alternative implementations, two or more fluid grooves 372*a-e*, 378*a-e* can be positioned between adjacent latch openings 306*a-e*. Additionally, in one or more implementations the fluid grooves 372*a-e*, 378*a-e* can be equally circumferentially spaced about the latch body 206. In alternative implementations, the fluid grooves 372*a-e*, 378*a-e* can be staggered or otherwise not equally circumferentially spaced about the latch body 206.

In addition to the fluid grooves 372*a-e*, 378*a-e*, the latch body 206 can further include one or more fluid ports as mentioned previously. For example, FIGS. 5-6D illustrate that the latch body 206 can include a pair of fluid ports 370*a* and 370*b* proximate a first end 388 of the latch body 206, and a pair of fluid ports 376*a*, 376*b* proximate a second opposing end 390 of the latch body 206. Additionally, the latch body 206 can include one or more fluid ports 389*a*, 389*b* proximate the center of the latch body 206. The fluid ports 389*a*, 389*b* proximate the center of the latch body 206 can be formed by notches 387 formed in the sleeve 204 that align with slots 385 formed in the driving member 302. One will appreciate that the fluid ports 389*a*, 389*b* can increase in size as the driving member 302 is withdrawn from the sleeve 204.

One will appreciate in light of the disclosure herein that the fluid ports 370*a-b*, 376*a-b*, 389*a-b* can allow fluid to flow between the inner surfaces 382, 386 and the outer surfaces 380, 384 of the latch body 206. Thus, the fluid ports 370*a-b*, 376*a-b*, 389*a-b* can allow fluid to flow through and past portions of the core barrel assembly 110 where fluid flow may otherwise be limited by geometry or by features within the core barrel assembly 110. Additionally, the fluid ports 370*a-b*, 376*a-b*, 389*a-b* can allow fluid to flow into the latch body 206 so as to be able to act on the fluid control member 342 or to flow past any seals included between the outer surfaces of the core barrel assembly 110 and the inner surface of the drill string 104 (such as seals that allow the core barrel assembly 110 to be hydraulically pumped through a drill string 104).

In at least one implementation the fluid ports 370*a-b*, 376*a-b* can be enclosed. In other words, the fluid ports 370*a-b*, 376*a-b* can be formed entirely within the latch body 206 versus at an edge like notch 387. Furthermore, while FIGS. 5-6D illustrate two fluid ports 370*a-b* proximate the first end 388, two fluid ports 389*a-b* proximate the middle of the latch body 206, and two fluid ports 376*a-b* proximate the second end 390, in alternative implementations the latch body can include more or less fluid ports. Additionally, in one or more implementations each set of fluid ports 370*a-b*, 376*a-b*, 389*a-b* can be equally circumferentially spaced about the latch body 206 as shown in FIGS. 5-6D. In alternative implementations, each set of fluid ports 370*a-b*, 376*a-b*, 389*a-b* can be staggered or otherwise not equally circumferentially spaced about the latch body 206. Also, the fluid ports fluid ports 370*a-b* proximate the first end 388 can be circumferentially aligned with the fluid ports 376*a-b* proximate the second end 390 as shown by FIGS. 5-6D. In alternative implementations the fluid ports fluid ports 370*a-b* proximate the first end 388 can be circumferentially misaligned with the fluid ports 376*a-b* proximate the second end 390.

As shown in the Figures, the fluid ports 370*a-b*, 376*a-b* can have a relatively large size to allow for significant fluid flow between the inside and outside of the latch body 206. For example, in one or more implementations each fluid port 370*a-b*, 376*a-b* can have a width (distance spanned radially about the latch body 206) between about five percent and about thirty percent of the circumference of the latch body 206. In further implementations, each fluid port 370*a-b*, 376*a-b* can have a width between about ten percent and about twenty-five percent of the circumference of the latch body 206. In still further implementations, each fluid port 370*a-b*, 376*a-b* can have a width between about fifteen percent and about twenty percent of the circumference of the latch body 206. Furthermore, in one or more implementations each fluid port 370*a-b*, 376*a-b* can have a height (distance spanned axially along the latch body 206) approximately equal to the width(s) described herein above.

In one or more implementations, one or more of the fluid grooves 372*a-e*, 378*a-e* can be in fluid communication with one or more of the fluid ports 370*a-b*, 376*a-b*, 389*a-b*. One will appreciate in light of the disclosure herein that fluid communication between the fluid grooves 372*a-e*, 378*a-e* and fluid ports 370*a-b*, 376*a-b*, 389*a-b* can direct fluid axially along the latch body 206 into the interior or the latch body 206 and vice versa. As shown in FIGS. 5-6D in one or more implementations each fluid groove 372*a-e*, 378*a-e* can intersect at least one fluid port 370*a-b*, 376*a-b*, 389*a-b*. Still further, one or more combined fluid grooves (i.e., 378*a* and 372*a* etc.) can insect both a fluid port 370*a* proximate the first end 388 and a fluid port 376*a* proximate the second end 390. In alternative implementations, the fluid grooves 372*a-e*, 378*a-b* may not intersect any fluid ports 370*a-b*, 376*a-b*, 389*a-b*.

In addition to the fluid grooves, in one or more implementations the latch body 206 can further include one or more flats 392 as shown by FIG. 5. The flats 392 can comprise flattened areas of the outer surfaces 380, 384 of the latch body 206. Similar to the fluid grooves, the flats 392 can increase the space between the outer surfaces of the core barrel assembly and the inner surface of the drill string 104, and provide for increased fluid flow therein.

Figure 7:
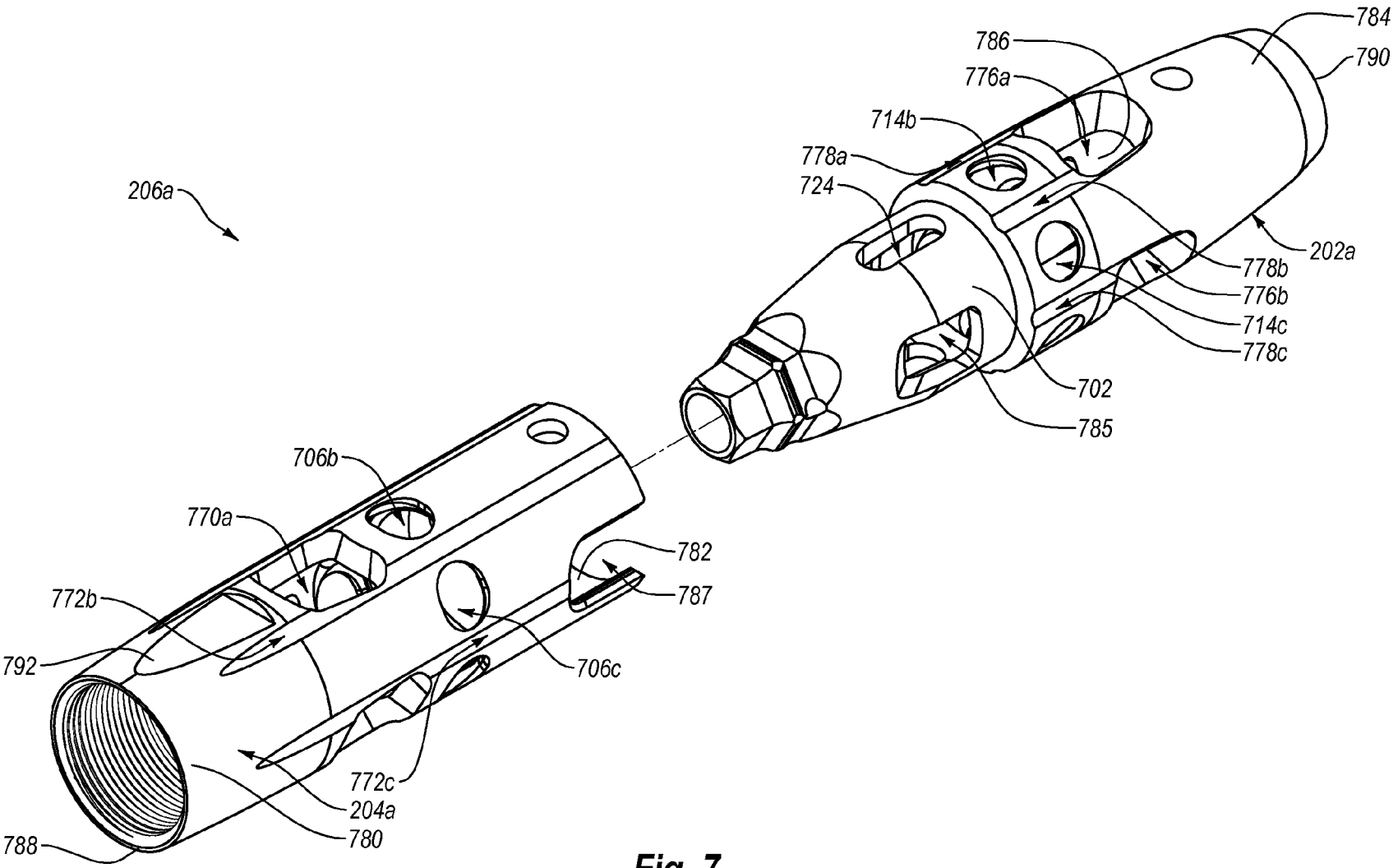
FIG. 7 illustrates an exploded perspective view of another implementation of a latch body including external fluid pathways in accordance with an implementation of the present invention.

As previously mentioned, the fluid grooves of one or more implementations of the present invention can be incorporated into various different types of latch bodies. For example, FIGS. 7-8F illustrate a latch body 206*a* configured to house both a driven latch mechanism and a braking mechanism such as the braking mechanism described in patent application Ser. No. 12/898,878, filed on Oct. 6, 2010. As shown by FIGS. 7-8F, the latch body 206*a* can include a plurality of fluid grooves. In particular, the latch body 206*a* can include six fluid grooves 772*a-f* on the sleeve 204*a* and six fluid grooves 776*a-f* on the first member 202*a*. Each of the fluid grooves 772*a-e*, 776*a-e* can extend into the outer surfaces 780, 784 of the latch body 206*a* toward the inner surfaces 782, 786 of the latch body 206*a*.

In addition to extending radially into the outer surfaces 780, 784 of the latch body 206*a*, the fluid grooves 772*a-f*, 778*a-f* can extend axially along at least a portion of the length of the latch body 206*a*. In one or more implementations the fluid grooves 772*a-f* of the sleeve 204*a* can align with the fluid grooves 778*a-f* of the first member 202 such that the fluid grooves 772*a-f*, 778*a-f* extend substantially the entire length of the latch body 206*a*. In such implementations, the fluid grooves 772*a* and 778*a* can be considered a single fluid groove.

Figures 8A, 8B, 8C, 8D:
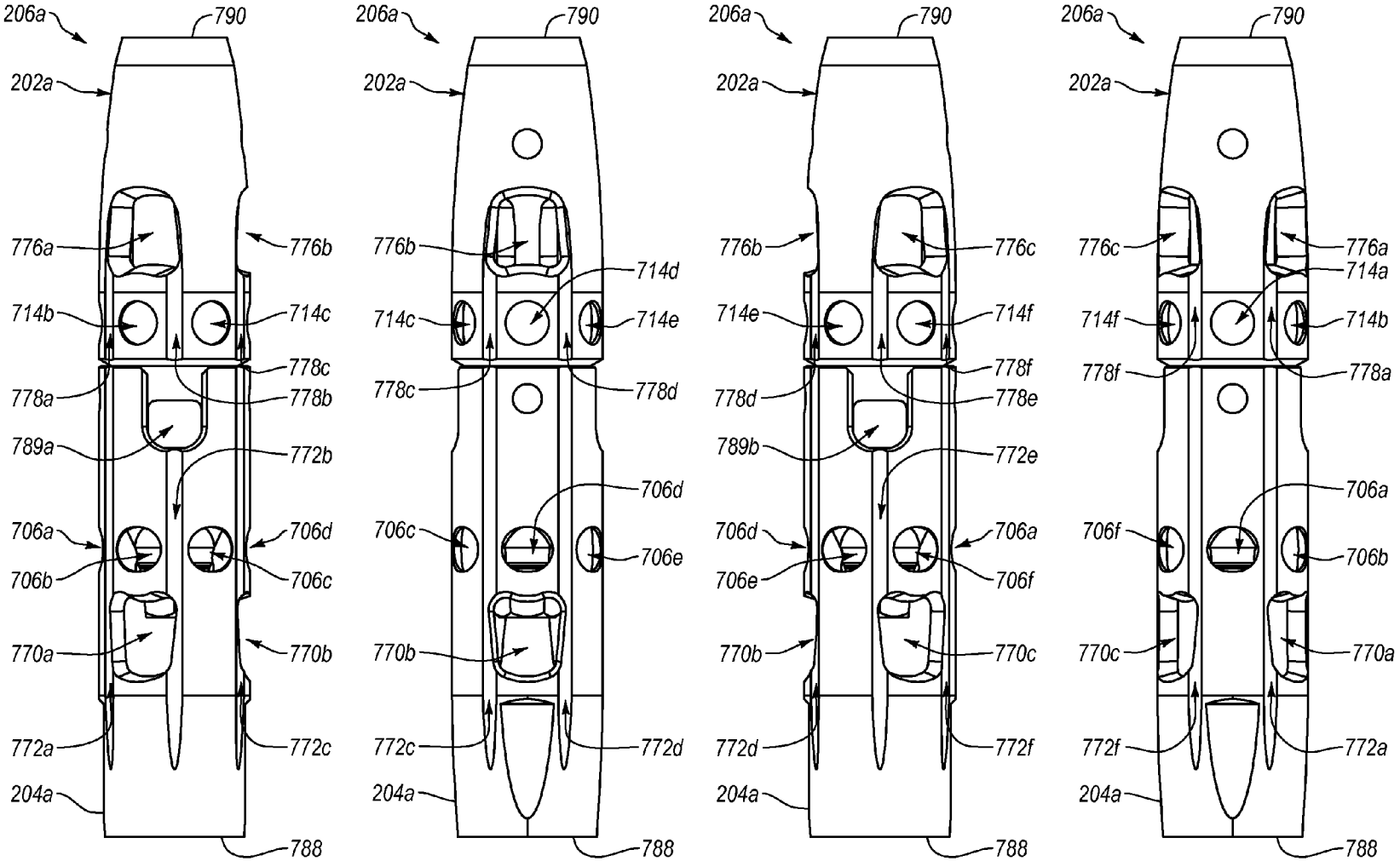
FIG. 8A illustrates a side view of the latch body of FIG. 7.
FIG. 8B illustrates a side view of the latch body of FIG. 7, similar to FIG. 8A, albeit rotated by 90 degrees.
FIG. 8C illustrates a side view of the latch body of FIG. 7, similar to FIG. 8A, albeit rotated by degrees 180 degrees.
FIG. 8D illustrates a side view of the latch body of FIG. 7, similar to FIG. 8A, albeit rotated by 270 degrees.
Figure 8E:
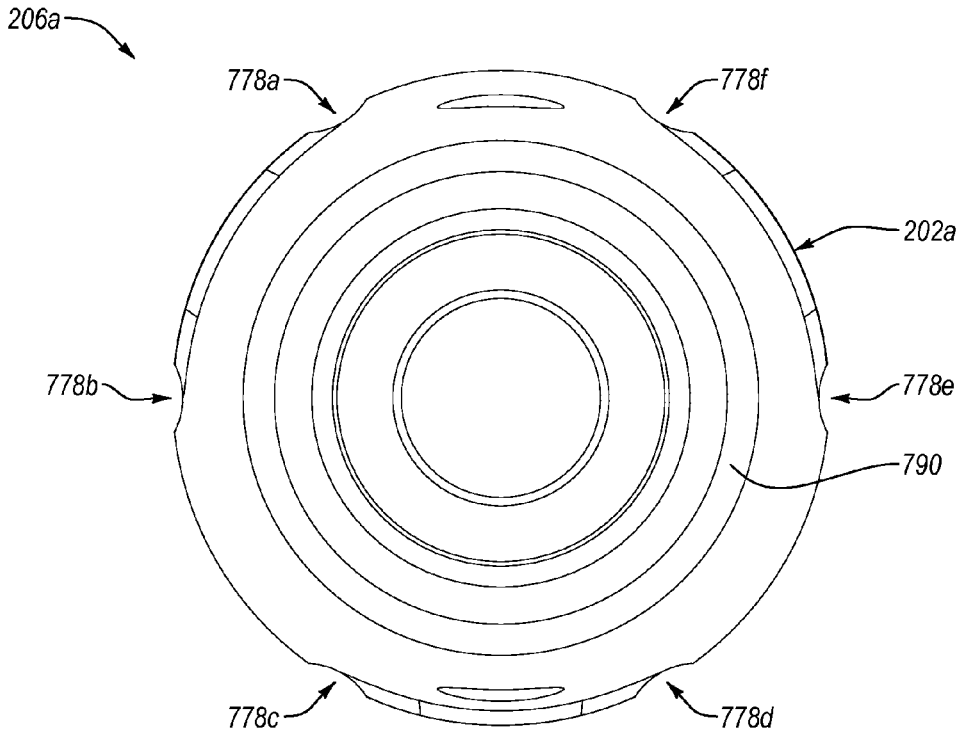
FIG. 8E illustrates a top view of the latch body of FIG. 7.
Figure 8F:
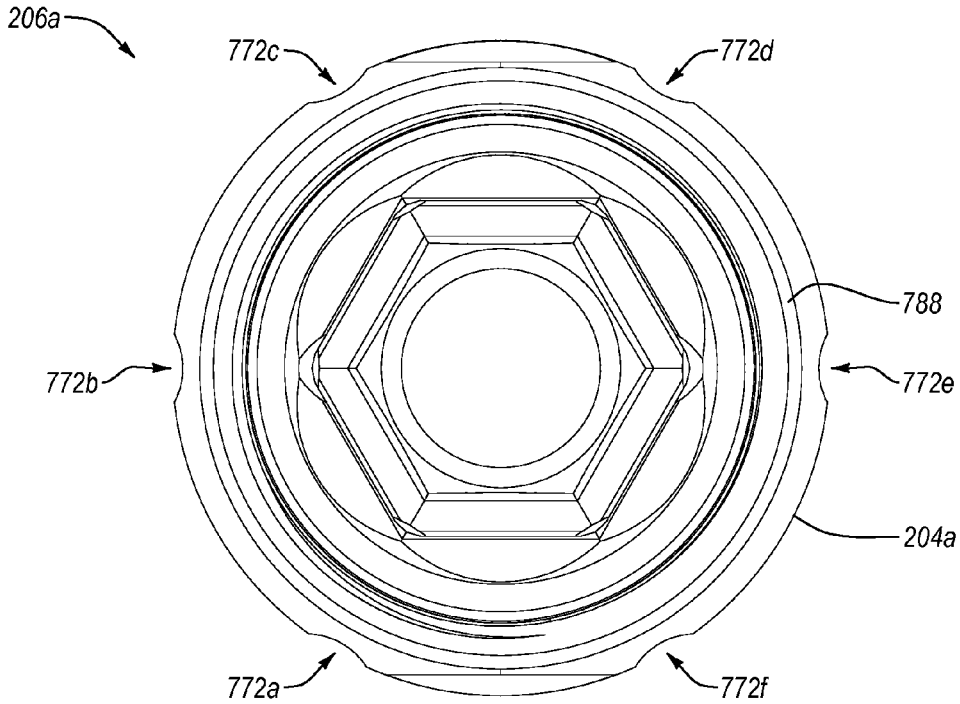
FIG. 8F illustrates a bottom view of the latch body of FIG. 7.

As shown by FIGS. 7-8D, the latch body 206*a* can include a plurality of brake openings 314*a-f*. The brake openings 314*a-f*, like the latch openings 706*a-e*, can extend through the latch body 206*a* from the inner surfaces 782, 786 to the outer surfaces 780, 784. The brake openings 714*a-f* can allow braking elements (not shown) to radially retract into and extend out of the latch body 206*a*. As described in U.S. patent application Ser. No. 12/898,878, filed on Oct. 6, 2010, the braking elements can help prevent unintended expulsion of the core barrel assembly 110 from the drill string 104. Thus, the braking mechanism can allow core barrel assembly 110 to be used in up-hole drilling operations without the danger of the core barrel assembly 110 sliding out of the drill string 104 in an uncontrolled and possibly unsafe manner. Accordingly, the braking mechanism can resist unintended removal or expulsion of the core barrel assembly 110 from the borehole by deploying the braking elements into a frictional arrangement between an inner wall of the casing or drill string 104 (or borehole).

In one or more implementations the number of fluid grooves 772*a-f*, 778*a-f* can be based on the number of latch openings 706*a-f* and/or brake openings 314*a-f*. For example, FIGS. 7-8D show that the latch body 206*a* can include six latch openings 706*a-e*, six brake openings 314*a-f*, and six fluid grooves 772*a-f*, 778*a-f*. In particular, each of the fluid grooves 772*a-f*, 778*a-f* can be positioned circumferentially between adjacent latch openings 706*a-e* and between adjacent brake openings 314*a-f*. This can allow fluid to flow between the outer surfaces 780, 784 of the latch body 206*a* and the inner surface of the drill string 104 even when the wedge members 300 and/or the brake elements (not shown) are engaged with the drill string 104.

In addition to the fluid grooves 772*a-f*, 778*a-f*, the latch body 206*a* can further include one or more fluid ports as mentioned previously. For example, FIGS. 7-8D illustrate that the latch body 206*a* can include three fluid ports 770*a*, 770*b*, 770*c* proximate a first end 788 of the latch body 206*a*, and three fluid ports 776*a*, 776*b*, 776*c* proximate a second opposing end 790 of the latch body 206*a*. Additionally, the latch body 206*a* can include one or more fluid ports 789*a*, 789*b* proximate the center of the latch body 206*a*. The fluid ports 789*a*, 789*b* proximate the center of the latch body 206*a* can be formed by notches 787 formed in the sleeve 204*a* that align with slots 785 formed in the driving member 702. One will appreciate that the fluid ports 789*a*, 789*b* can increase in size as the driving member 702 is withdrawn from the sleeve 204*a*. As shown in FIG. 7, in at least one implementation the slots 785 can be ninety degrees offset from the mounting slots 724.

In one or more implementations, one or more of the fluid grooves 772*a-f*, 778*a-f* can be in fluid communication with one or more of the fluid ports 770*a-b*, 776*a-b*, 789*a-b*. One will appreciate in light of the disclosure herein that fluid communication between the fluid grooves 772*a-f*, 778*a-f* and fluid ports 770*a-b*, 776*a-b*, 789*a-b* can direct fluid axially along the latch body 206*a* into the interior or the latch body 206*a* and vice versa. As shown in FIGS. 7-8D in one or more implementations each fluid groove 772*a-f*, 378*a-e* can intersect at least one fluid port 770*a-b*, 776*a-b*, 789*a-b*. Still further, one or more combined fluid grooves (i.e., 378*a* and 772*a* etc.) can insect both a fluid port 770*a* proximate the first end 788 and a fluid port 776*a* proximate the second end 790. Still further, one or more combined fluid grooves (i.e., 378*e* and 772*e* etc.) can insect both a fluid port 770*c* proximate the first end 788, a fluid port 776*c* proximate the second end 790, and a fluid port 789*b* proximate the middle of the latch body 206*a*. In alternative implementations, the fluid grooves 772*a-f*, 778*a-e* may not intersect any fluid ports 770*a-b*, 776*a-b*, 789*a-b*.

In addition to the fluid grooves, in one or more implementations the latch body 206*a* can further include one or more flats 792 as shown by FIG. 7. The flats 792 can comprise flattened areas of the outer surfaces 780, 784 of the latch body 206*a*. Similar to the fluid grooves, the flats 792 can increase the space between the outer surfaces of the core barrel assembly and the inner surface of the drill string 104, and provide for increased fluid flow therein.

Figure 9:
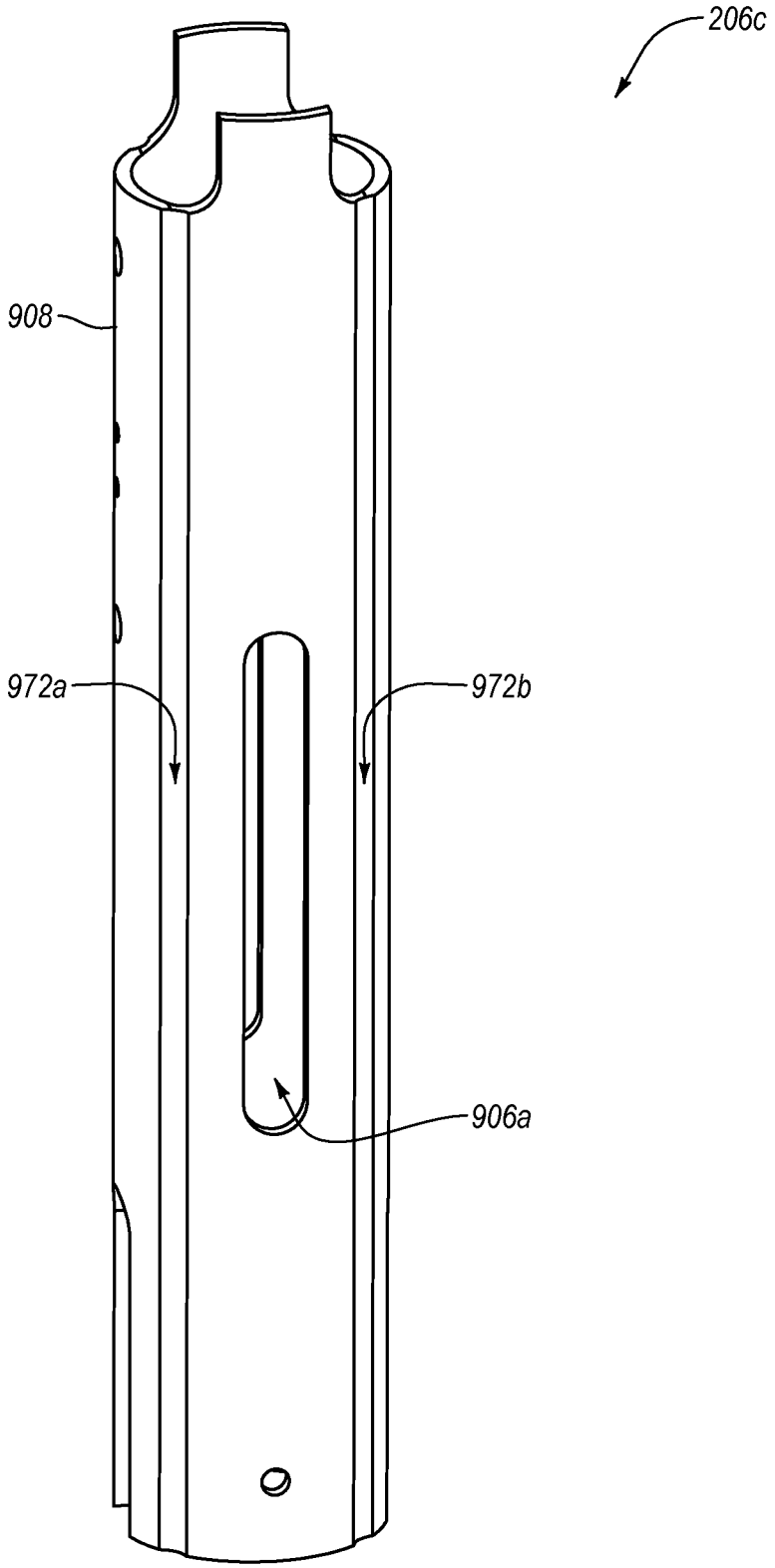
FIG. 9 illustrates a perspective view of yet another implementation of a latch body including external fluid pathways in accordance with an implementation of the present invention.

The fluid grooves and fluid ports can be incorporated into any core barrel component not only the latch body. Furthermore, the fluid grooves and/or fluid ports can be used with any latching mechanism or latch body design. For example, FIG. 9 illustrates a latch body 206*c* configured to house a latching mechanism with latch arms that pivot out of elongated latch openings 906*a*. As shown by FIG. 9, the latch body 206*c* can include fluid grooves 972*a*, 972*b* that extend into the outer surface 980 of the latch body 206*c*. In addition to extending radially into the outer surface 980, the fluid grooves 972*a*, 972*b* can extend axially along at least a portion of the length of the latch body 206*c*. Furthermore, the fluid grooves 972*a*, 972*b* can be positioned between latch openings 906*a*, and may not be in fluid communication with any fluid ports.

Figure 10:
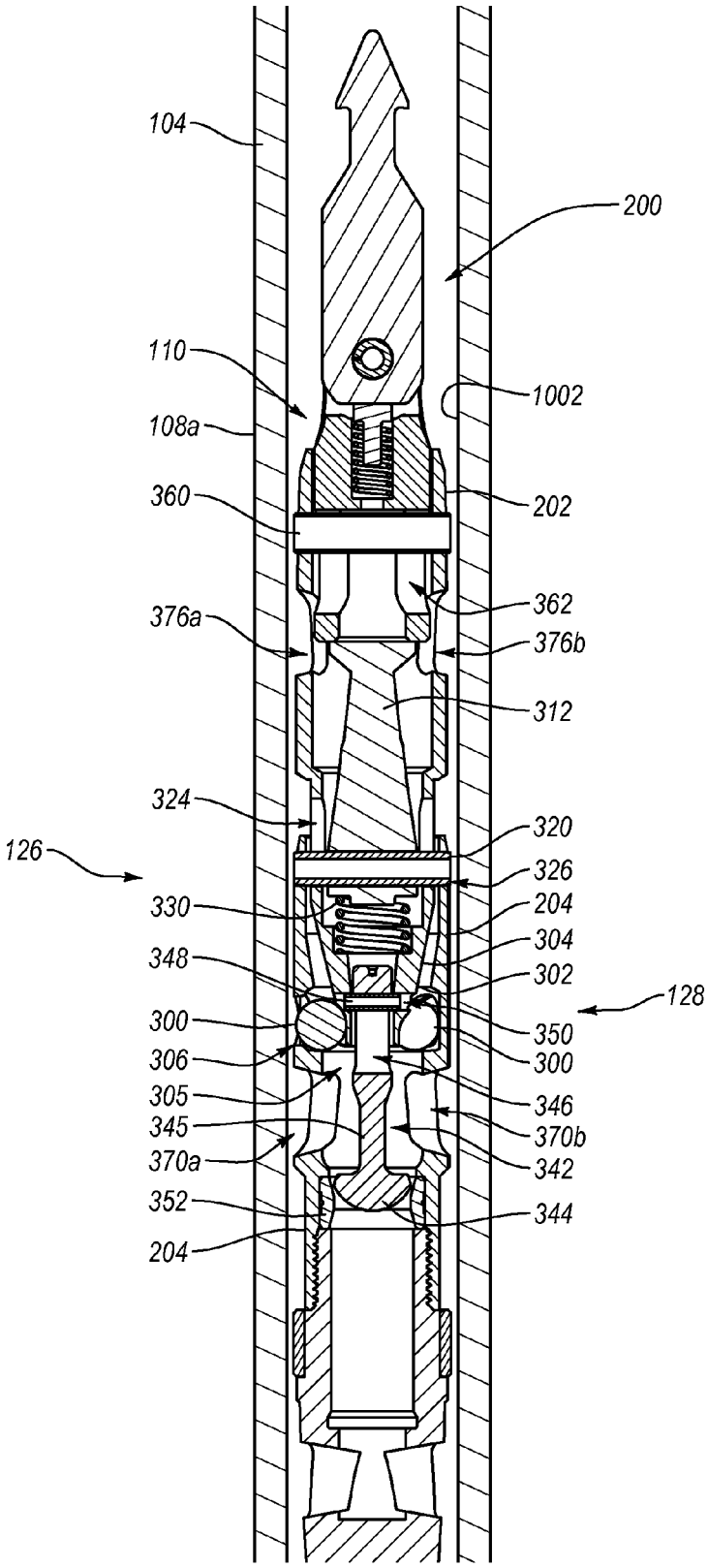
FIG. 10 illustrates a cross-sectional view of the core barrel assembly of FIG. 2 similar to FIG. 4, albeit with the driven latch mechanism locked in a retracted position for tripping the core barrel assembly into a drill string.

Referring now to FIGS. 10-13 operation of the core barrel assembly 110, driven latch mechanism 128, and fluid grooves 372*a-e*, 378*a-e* and fluid ports 376*a-b*, 370*a-b* will now be described in greater detail. As previously mentioned, in one or more implementations of the present invention the core barrel assembly 110 can be lowered into a drill string 104. For example, FIG. 10 illustrates the core barrel assembly 110 as it is tripped into or down a drill string 104.

As shown in one or more implementations, prior to placing the core barrel assembly 110 into the drill string 104, an operator can lock the wedge members 300 into the refracted groove 305. For example, the operator can press the pull the driving member 302 out of or away from the sleeve 204. By so doing the biasing member 330 can be compressed, and the wedge members 300 can be received into the retracted groove 305, as shown in FIG. 5.

As the core barrel assembly 110 travels down the drill string 104, drilling fluid and/or ground fluid within the drill string 104 may cause fluid drag and hydraulic resistance to the movement of the core barrel assembly 110. The fluid grooves 372*a-e*, 378*a-e* may allow the drilling fluid or other materials (e.g., drilling gases, drilling muds, debris, air, etc.) contained in the drill string 104 to flow past the core barrel assembly 110 in greater volume, and therefore allow the core barrel assembly 110 to travel faster along the drill string 104. Additionally, the fluid ports 376*a-b*, 370*a-b* can allow the drilling fluid or other materials to flow from the inside to the outside (and vice versa) of the latch body 206 to enable the fluid to flow around the latch mechanism 128 and other internal components of the core barrel assembly 110. Thus, in combination the fluid grooves 372*a-e*, 378*a-e* and fluid ports 376*a-b*, 370*a-b* can maximize the area within which fluid can flow, and thereby, reduce drag acting on the core barrel assembly 110 as it travel along the drill string 104.

Referring now to FIG. 11, once the in-hole assembly or core barrel assembly 110 has reached its desired location within the drill string 104; the distal end of the core barrel assembly 110 can pass through the last drill rod and land on a landing ring that sits on the top of the outer tube 112. At this point the latching mechanism 128 can deploy thereby locking the core barrel assembly 110 axially and rotationally to the drill string 104. For example, the impact of the core barrel assembly 110 contacting the landing ring, in combination with the biasing forces created by the biasing member 330, can overcome the retention force maintaining the wedge members 300 within the retracted groove 305.

Once the core barrel assembly 110 has landed on the landing seat, core barrel assembly 110 can be submerged in a fluid. During drilling operations, this fluid can be pressurized. The pressurization of the fluid, along with the sealing contact between the distal end of the core barrel assembly 110, can cause the pressurized fluid to enter the fluid ports 376*a-b*, 370*a-b*. Pressurized fluid entering the fluid ports 376*a-b*, 370*a-b* can produce a distally acting fluid force on the piston 344 of the fluid control member 342. The piston 344 in turn can exert a distally acting force that drives the fluid control member 342 distally until the proximal end of the channel 346 engages the pin 348. As a result, once the proximal end of the channel 346 engages the pin 348, the distally acting fluid force exerted on the fluid control member 342 is transferred through the pin 348 to the driving member 302, thereby pulling the driving member 302 toward or into the sleeve 204. This force created by the fluid control member 342 can work together with the biasing force created by the biasing member 330 to overcome the retention force maintaining the wedge members 300 within the retracted groove 305.

In any event, once the retention force has been overcome, the biasing member 330 can force the driving member 302 distally toward (and in some implementations at least partially into) the sleeve 204. Movement of the driving member 302 toward or into the sleeve 204 can urge the driving surfaces 304 into increasing engagement with the wedge members 300. In other words, axial translation of the driving member 302 toward the sleeve 204 can cause the driving surfaces 304 to force the wedge members 300 radially outward as they move along the tapered driving surfaces 304. This movement can cause the driving surfaces 304 drive the wedge members 300 radially outward (through the latch openings 306) and into engagement with the inner surface 1002 of the drill string 104. In particular, the wedge members 300 can be driven into engagement with an annular groove 1102 formed in the inner surface 1002 of the drill string 104 as shown by FIG. 11.

With the wedge members 300 deployed in the annular groove 1102, the driven latch mechanism 128 can lock the core barrel assembly 110 axially in the drilling position. In other words, the wedge members 300 and the annular groove 1102 can prevent axial movement of the core barrel assembly 110 relative to the outer tube 112 or drill string 104. In particular, the driven latch mechanism 128 can withstand the drilling loads as a core sample enters the core barrel 124. Additionally, the drive latch mechanism 128 can maintain a deployed or latched condition despite vibration and inertial loading of mating head assembly components, due to drilling operations or abnormal drill string movement.

One will appreciate that when in the drilling position, the biasing member 330 can force the driving member 302 distally, thereby forcing the wedge members 300 radially outward into the deployed position. Thus, the driven latch mechanism 128 can help ensure that the wedge members 300 do not disengage or retract unintentionally such that the core barrel inner tube assembly rises from the drilling position in a down-angled hole, preventing drilling.

In addition to the foregoing, FIG. 11 further illustrates that when in the drilling position, the piston 344 can pass distally beyond the bushing 352. This can allow fluid to flow within the core barrel assembly 110. Thus, the fluid control member 342 can allow drilling fluid to reach the drill bit 106 to provide flushing and cooling as desired or needed during a drilling process. One will appreciate in light of the disclosure herein that a pressure spike can be created and then released as the core barrel assembly 110 reaches the drilling position and the piston 344 passes beyond the bushing 352. This pressure spike can provide an indication to a drill operator that the core barrel assembly 110 has reached the drilling position, and is latched to the drill string 104.

In addition to axially locking or latching the core barrel assembly 110 in a drilling position, the driven latch mechanism 128 can rotationally lock the core barrel assembly 110 relative to the drill string 104 such that the core barrel assembly 110 rotates in tandem with the drill string 104. As previously mentioned, this can prevent wear between the mating components of the core barrel assembly 110 and the drill string 104 (i.e., the wedge members 300, the inner surface 1002 of the drills string 104, the landing shoulder at the distal end of the core barrel, the landing ring at the proximal end of the outer tube 112).

In particular, referring to FIG. 12 as the drill string 104 rotates (indicated by arrow 1200), the core barrel assembly 110 and the driving member 302 can have an inertia (indicated by arrow 1204) that without out the driven latch mechanism 128 may tend to cause the core barrel assembly 110 not to rotate or rotate a slow rate then the drill string 104. As shown by FIG. 12, however, rotation of the drill string 104 causes the wedge members 300 to wedge in between the driving surfaces 304 of the driving member 302 and the inner surface 1002 of the drill string 104 as the rotation of the drill string 104 tries to rotate the wedge members 300 relative to the driving member 302 (indicated by arrow 1202). The wedging or pinching of the wedge members 300 in between the driving surfaces 304 and the inner surface 1002 of the drill string 104 can rotationally lock the driving member 302 (and thus the core barrel assembly 110) relative to the drill string 104. Thus, the driven latch mechanism 128 can ensure that the core barrel assembly 110 rotates together with the drill string 104.

One will appreciated that while the driven latch mechanism 128 can provide increased latching strength and axially and rotationally lock the core barrel assembly 110 to the drill string 104; the driven latch mechanism 128 can also reduce the space within which fluid can flow past the core barrel assembly 110. For example, the increased number of latch members 300 engaging the drill string 104, the increased diameter of the latch body 206, and the larger more robust components within the latch body 206 can all reduce space within which fluid (such as drilling fluid being sent to cool the drill bit 106 (FIG. 1) can flow. As shown in FIG. 12, the fluid groove 372*a-e* can increase the space between the outer surface 380 of the latch body 206 and the inner surface 1002 of the drill string 104. This increased space can allow fluid to flow between the wedge members 300 and past the latch mechanism 128. Along similar lines, in implementations including a braking mechanism and a latch body 206*a* configured to house a braking mechanism, fluid groove 778*a-e* (FIGS. 7-8D) can allow fluid to fluid to flow between the braking elements and past the braking mechanism.

Figure 13:
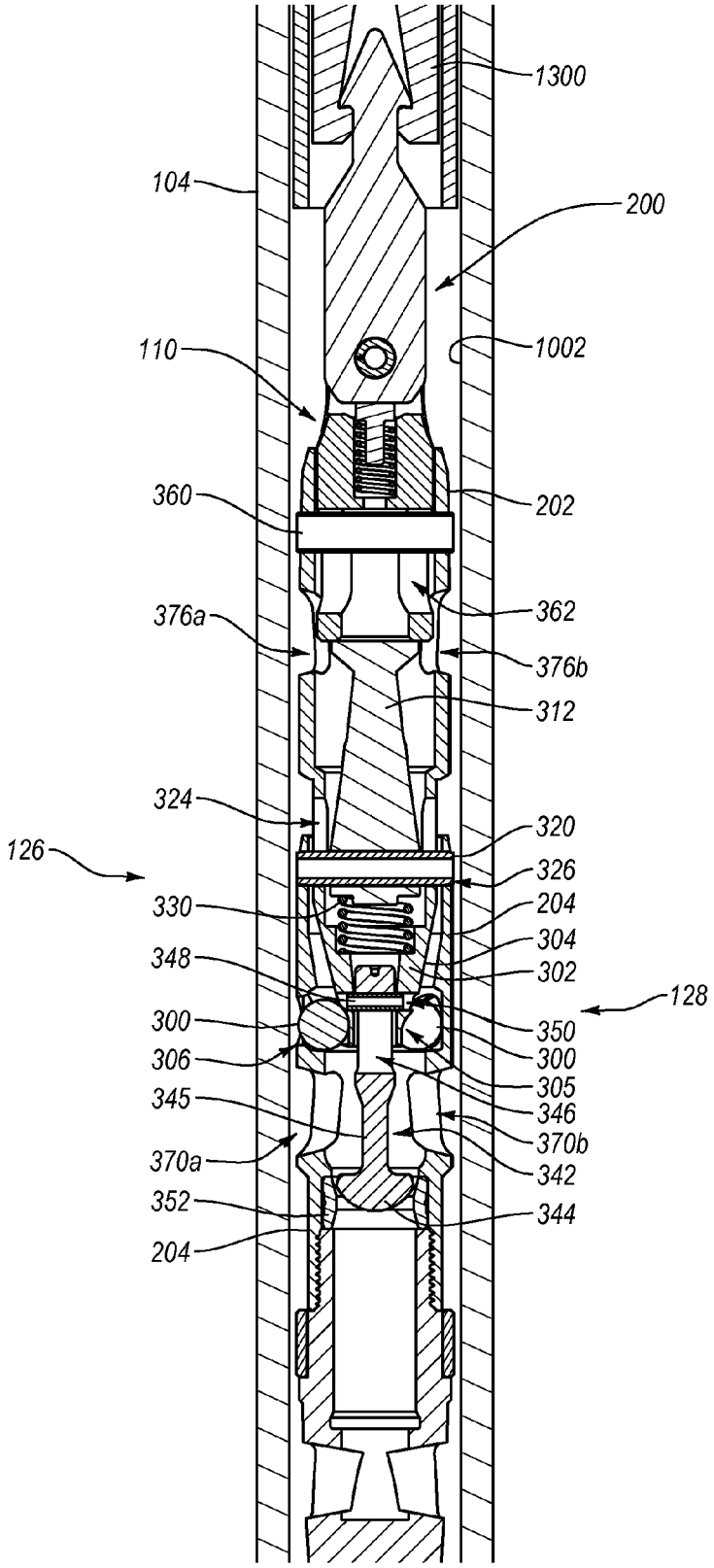
FIG. 13 illustrates a cross-sectional view of the core barrel assembly similar to FIG. 4, albeit with the driven latch mechanism in a released position allowing for retrieval of the core barrel assembly from the drill string.

At some point is may be desirable to retrieve the core barrel assembly 110, such as when a core sample has been captured. Referring to FIG. 13, in order to retrieve the core barrel assembly 110, a wireline can be used to lower an overshot assembly 1300 into engagement with the spearhead assembly 200. The wireline can then be used to pull the overshot 900 and spearhead assembly 200 proximally. This in turn can act to draw the first member 202 proximately away from the sleeve 204.

Proximal movement of the first member 202 can cause the driving member 302 to move relative to the sleeve 204 and the wedge members 300. Proximal movement of the driving member 302 relative to the wedge members 300 can cause the wedge members 300 to radially retract as they move along the tapered driving member 302. At this point, the distal end of the mounting slots 324 can engage the pin 320, thereby pulling the sleeve 204 proximately.

Implementations of the present invention can also include methods of drilling to obtain a core sample using a core drilling tools with retractably lockable driven latch mechanisms. The following describes at least one implementation of a method of obtaining a core sample with reference to the components and diagrams of FIGS. 1 through 13. Of course, as a preliminary matter, one of ordinary skill in the art will recognize that the methods explained in detail herein can be modified using one or more components of the present invention. For example, various acts of the method described can be omitted or expanded, and the order of the various acts of the method described can be altered as desired.

Thus, according to one implementation of the present invention, the method can involve inserting said core barrel assembly 110 within a drill string 104. For example, a user can lower the core barrel assembly 110 into the drill string 104. The core barrel assembly can include at least one fluid groove 372*a-e*, 378*a-e* extending into an outer surface 380, 384 of the core barrel assembly 110. The at least one fluid groove 372*a-e*, 378*a-e* can extend axially along the outer surface 380, 384 of the core barrel assembly 110.

The method can then involve sending the core barrel assembly 110 along the drill string 104 to a drilling position. In at least one implementation, the core barrel assembly 110 can move along or down the drill string 104 to the drilling position under the force of gravity. In another implementation, the core barrel assembly 110 can be forced along or down the drill string 104 by hydraulic forces. In any event, as the core barrel assembly 110 moves down the drill string 104, fluid can flow in the at least one fluid groove 372*a-e*, 378*a-e* from a first end 388 of a latch body 206 to a second end 390 of the latch body 206.

Upon reaching the drilling position, the plurality of wedge members 300 can automatically move out of the at least one retracted groove 305 into a deployed position in which the plurality of wedge members 300 extend at least partially radially outward of the sleeve 204. For example, a biasing force created by the biasing member 330 the retention force maintaining the wedge members 300 within the refracted groove 305 can be overcome. In some implementations, the biasing force can work in combination with an impact force created by the impact of the core barrel assembly 110 contacting the landing ring and/or a force generated by fluid acting on the fluid control member 342 to overcome the retention force. The biasing member 330 can then force driving member 302 to move axially relative to sleeve 204. This movement can force the wedge member 300 radially outward of the sleeve 204 until they engage the annular groove 1102 within the drill string 104; thereby, locking the core barrel assembly 110 axially to the drill string 104. In some implementations, movement of the driving member 302 relative to sleeve 204 can force the wedge members 300 into the deployment groove 802, which can lock the wedge members 300 in the extended or deployed position.

The method can then involve rotating the drill string 104; thereby, causing the plurality of wedge members 300 to wedge between an inner surface 1002 of said drill string 104 and the driving member 302, thereby rotationally locking the core barrel assembly 110 relative to the drill string 104. Still further, the method can involve advancing the drill string 104 into a formation 102 thereby causing a portion of the formation 102 to enter the core barrel assembly 110.

As previously alluded to previously, numerous variations and alternative arrangements may be devised by those skilled in the art without departing from the spirit and scope of this description. For example, core barrel assembly in accordance with the present invention can include fluid grooves formed not only in latch bodies but also other components of the core barrel assembly. For instance, the fluid grooves and or fluid ports can be included on the core barrel. Thus, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

I claim:

1. A latch body of a core barrel assembly, comprising:

a tubular body comprising a first member, a sleeve, an outer surface, and an inner surface, the first member being moveably coupled to the sleeve, wherein the tubular body is adapted to house a latch mechanism for securing the tubular body to a drill string;

at least two latch openings extending through the tubular body;

at least one fluid groove extending into the outer surface of the tubular body, wherein the at least one fluid groove extends axially along the outer surface of the tubular body;

a first fluid port extending through the tubular body, and a driving member coupled to the first member, the driving member being configured to be received within the sleeve, wherein the first fluid port is adapted to allow fluid to flow between the inner surface and the outer surface, wherein the first fluid port is positioned proximate a first end of the tubular body, and wherein at least one fluid groove intersects the first fluid port.

2. The latch body as recited in claim 1, wherein the at least one fluid groove is positioned between the at least two latch openings.

3. The latch body as recited in claim 1, wherein the at least one groove extends along the entire length of the tubular body.

4. The latch body as recited in claim 1, further comprising:

a second fluid port extending through the tubular body;

wherein the second fluid port is adapted to allow fluid to flow between the inner surface and the outer surface; and wherein the second fluid port is positioned proximate a second end of the tubular body, the second end being opposite the first end.

5. The latch body as recited in claim 4, wherein at least one fluid groove intersects the first fluid port and the second fluid port.

6. The latch body as recited in claim 1, wherein the at least two latch openings each comprise a generally circular shape.

7. The latch body as recited in claim 6, wherein the at least two latch openings comprise five latch openings.

8. The latch body as recited in claim 7, wherein the at least one fluid groove comprises five fluid grooves equally circumferentially spaced about the tubular body.

9. A latch body of a core barrel assembly, comprising:

a tubular body comprising an outer surface, an inner surface, a first member, and a sleeve, the first member being moveably coupled to the sleeve, the tubular body being adapted to house a latch mechanism for securing the tubular body to a drill string;

a driving member coupled to the first member, the driving member being configured to be received within the sleeve, at least one fluid port extending through the tubular body, the at least one fluid port being adapted to allow fluid to flow between the inner surface and the outer surface; and at least one fluid groove extending into the outer surface of the tubular body, wherein the at least one fluid groove extends axially along the outer surface of the tubular body and intersects the at least one fluid port, wherein the at least one fluid groove extends axially along both the first member and the sleeve.

10. The latch body as recited in claim 9, wherein the at least one fluid groove has a linear configuration.

11. The latch body as recited in claim 9, wherein the at least one fluid port has a width between about five percent and thirty percent of a circumference of the tubular body.

12. The latch body as recited in claim 9, wherein the at least one fluid port comprises:

a first fluid port positioned proximate a first end of the tubular body; and a second fluid port positioned proximate a second end of the tubular body, the second end being opposite the first end.

13. The latch body as recited in claim 9, wherein the at least one fluid groove comprises a plurality of fluid grooves circumferentially spaced about the tubular body.

14. A core barrel head assembly, comprising:

a latch body comprising an inner surface and an outer surface;

a plurality of latch openings extending through the latch body;

a latch mechanism secured within the latch body, the latch mechanism comprising a plurality of latch members configured to move radially in and out of the plurality of latch openings; at least one fluid groove extending into the outer surface, the at least one fluid groove extending axially along the outer surface of the tubular body; and a first fluid port extending through the latch body, wherein the first fluid port is adapted to allow fluid to flow between the inner surface and the outer surface, wherein the first fluid port is positioned proximate a first end of the tubular body, and wherein at least one fluid groove intersects the first fluid port.

15. The core barrel head assembly as recited in claim 14, wherein the latch members comprise generally spherical wedge members.

16. The core barrel head assembly as recited in claim 14, wherein the at least one fluid groove is positioned between the adjacent latch openings of the plurality of latch openings.

17. The core barrel head assembly as recited in claim 14, wherein the at least one fluid groove extends along the entire length of the latch body.

18. The core barrel head assembly as recited in claim 14, further comprising:

a second fluid port extending through the latch body;

wherein the second fluid port is adapted to allow fluid to flow between the inner surface and the outer surface; and wherein the second fluid port is positioned proximate a second end of the latch body, the second end being opposite the first end.

19. The core barrel head assembly as recited in claim 18, wherein at least one fluid groove intersects the first fluid port and the second fluid port.

20. A drilling system for retrieving a core sample, comprising:

a drill string comprising a plurality of drill rods;

a core barrel assembly adapted to be inserted within the drill string, the core barrel assembly comprising:

a latch body;

a driven latch mechanism positioned within the latch body, the driven latch mechanism being configured to lock the core barrel assembly relative to the drill string;

a fluid port extending through the latch body; and at least one fluid groove extending into an outer surface of the latch body, the at least one fluid groove extending axially along the outer surface of the tubular body, the at least one fluid groove intersecting the fluid port, wherein the driven latch mechanism is adapted to rotationally and axially lock the core barrel assembly to the drill string.

21. The drilling system as recited in claim 20, wherein at least one drill rod of the plurality of drill rods comprises an inner diameter that varies along the length of the at least one drill rod.

22. The drilling system as recited in claim 20, further comprising a plurality of latch openings extending through the latch body.

23. The drilling system as recited in claim 20, wherein the at least one fluid groove is positioned between adjacent latch openings of the plurality of latch openings.

24. A method of drilling, comprising:

using a drilling system as recited in claim 20;

inserting the core barrel assembly within the drill string;

sending the core barrel assembly along the drill string to a drilling position, whereby fluid flows in the at least one fluid groove from a first end of the latch body to a second end of the latch body, as the core barrel assembly travels along the drill string; and rotating the drill string thereby causing the plurality of latch members to extend radially from the core barrel assembly into an annular groove of the drill string, thereby locking the core barrel assembly relative to the drill string.

25. The method as recited in claim 24, further comprising:

lowering an overshot onto a spearhead of the core barrel assembly; and pulling on the overshot to retract the core barrel assembly;

wherein the pulling moves the plurality of latch members into the core barrel assembly.

26. The method as recited in claim 24, further comprising advancing the drill string into a formation thereby causing a portion of the formation to enter the core barrel assembly.

* * * * *